US010539901B2

(12) United States Patent
Ishidate et al.

(10) Patent No.: US 10,539,901 B2
(45) Date of Patent: Jan. 21, 2020

(54) IMAGE FORMING APPARATUS HAVING OPTICAL PRINT HEAD

(71) Applicant: CANON KABUSHIKI KAISHA, Tokyo (JP)

(72) Inventors: Takehiro Ishidate, Tokyo (JP); Yasuaki Otoguro, Abiko (JP); Yuta Okada, Moriya (JP); Daisuke Aruga, Abiko (JP); Hitoshi Iwai, Abiko (JP); Shinichiro Hosoi, Tokyo (JP); Yuichiro Imai, Tokyo (JP); Toshiki Momoka, Tokyo (JP); Yoshitaka Otsubo, Tokyo (JP); Saimon Gokyu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/001,344

(22) Filed: Jun. 6, 2018

(65) Prior Publication Data

US 2018/0364609 A1 Dec. 20, 2018

(30) Foreign Application Priority Data

Jun. 16, 2017 (JP) ..... 2017-119007

(51) Int. Cl.

| | |
|---|---|
| ***G03G 15/00*** | (2006.01) |
| ***G03G 15/04*** | (2006.01) |
| ***G03G 21/16*** | (2006.01) |

(52) U.S. Cl.

CPC . *G03G 15/04036* (2013.01); *G03G 15/04054* (2013.01); *G03G 21/1666* (2013.01); *G03G 2215/0409* (2013.01)

(58) Field of Classification Search

CPC ..... G03G 15/04036; G03G 15/04054; G03G 15/04063; G03G 21/1666; G03G 2215/0407; G03G 2215/0409; G03G 2215/0412

USPC ..... 399/4, 118; 347/138, 152

See application file for complete search history.

(56) References Cited

U.S. PATENT DOCUMENTS

| | | | |
|---|---|---|---|
| 7,679,798 | B2 | 3/2010 | Sowa et al. |
| 8,112,012 | B2 | 2/2012 | Wong et al. |
| 8,269,812 | B2 | 9/2012 | Morimoto et al. |
| 8,305,419 | B2 | 11/2012 | Morita |
| 8,725,028 | B2 | 5/2014 | Imai |
| 2007/0024943 | A1 | 2/2007 | Namba |

(Continued)

FOREIGN PATENT DOCUMENTS

| | | | |
|---|---|---|---|
| JP | 2006258909 A | * | 9/2006 |
| JP | 2007072321 A | | 3/2007 |

(Continued)

*Primary Examiner* — Robert B Beatty

(74) *Attorney, Agent, or Firm* — Canon U.S.A., Inc. IP Division

(57) ABSTRACT

A simple structure is provided to move an optical print head toward a photosensitive drum. An image forming apparatus includes an optical print head having a first link portion and a second link portion, a sliding portion configured to move by sliding as to an image forming apparatus main body, and an abutting portion where one end of the optical print head abuts. When the sliding portion moves by sliding, the first link portion and the second link portion pivot as to the sliding portion, with the one end of the optical print head abutting the abutting portion, and the optical print head moves toward the photosensitive drum.

20 Claims, 21 Drawing Sheets

(56) References Cited

U.S. PATENT DOCUMENTS

| | | | | |
|---|---|---|---|---|
| 2007/0126852 | A1 | 6/2007 | Fukutome | |
| 2010/0245525 | A1 | 9/2010 | Morimoto et al. | |
| 2010/0271639 | A1* | 10/2010 | Iijima | B41J 19/20 358/1.5 |
| 2011/0050834 | A1* | 3/2011 | Umezawa | G03G 15/326 347/224 |
| 2012/0177418 | A1 | 7/2012 | Hashiyada et al. | |
| 2012/0207511 | A1* | 8/2012 | Sato | G03G 21/1633 399/110 |
| 2013/0164027 | A1 | 6/2013 | Sato et al. | |
| 2013/0170855 | A1 | 7/2013 | Mori et al. | |
| 2013/0194369 | A1 | 8/2013 | Shimamoto | |
| 2014/0212170 | A1 | 7/2014 | Kato et al. | |
| 2015/0050043 | A1 | 2/2015 | Sato et al. | |
| 2015/0109398 | A1 | 4/2015 | Park et al. | |
| 2018/0095405 | A1 | 4/2018 | Iwai et al. | |

FOREIGN PATENT DOCUMENTS

| | | | | |
|---|---|---|---|---|
| JP | 2009244542 | A | | 10/2009 |
| JP | 2010230954 | A | | 10/2010 |
| JP | 2011020414 | A | * | 2/2011 |
| JP | 2012234200 | A | | 11/2012 |
| JP | 2013134370 | A | | 7/2013 |
| JP | 2014213541 | A | | 11/2014 |
| JP | 2015018132 | A | | 1/2015 |

* cited by examiner

FIG. 5A
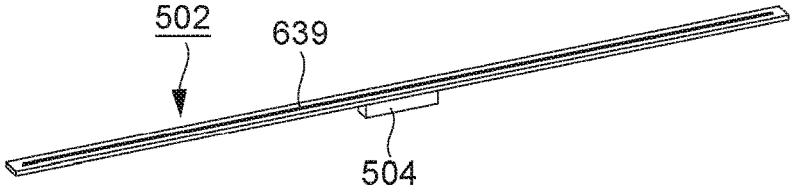
FIG. 5B1
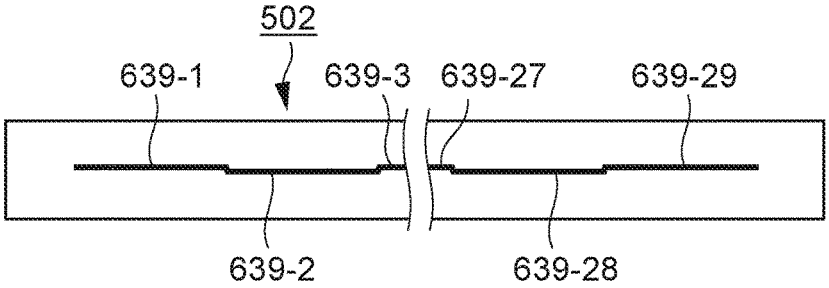
FIG. 5B2
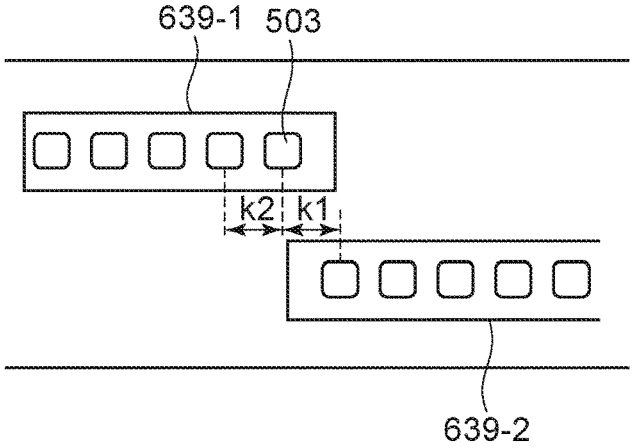
FIG. 5C1
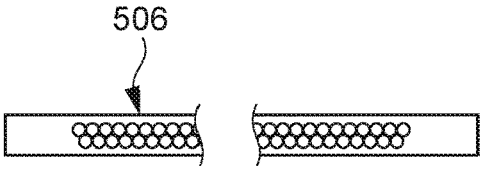
FIG. 5C2
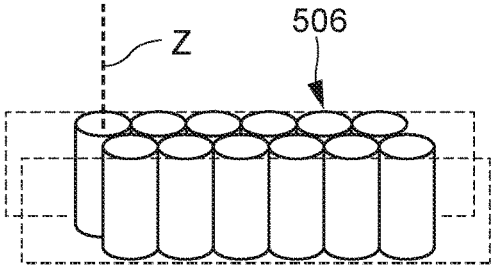

FIG. 7A1
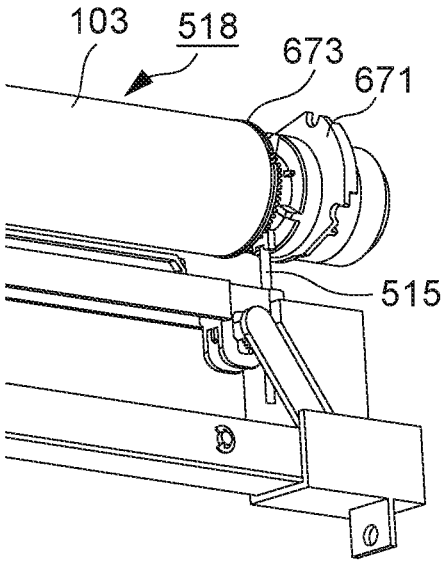
FIG. 7A2
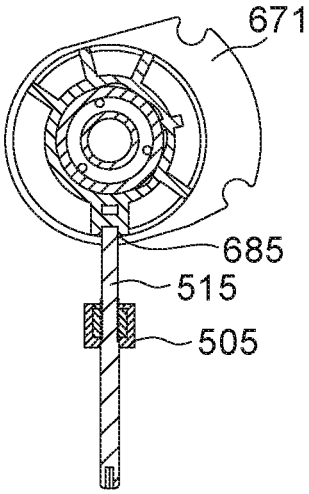
FIG. 7B1
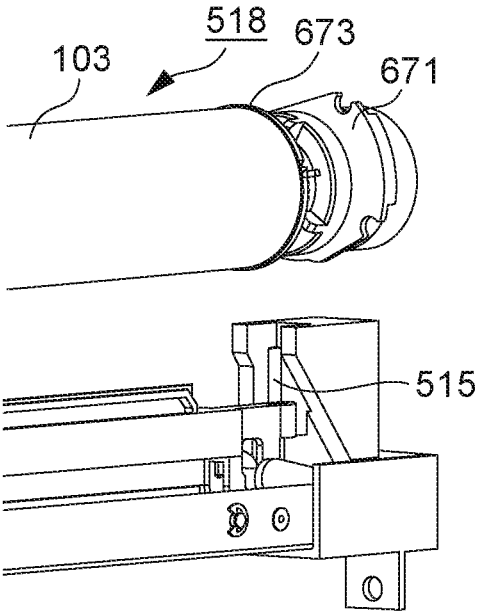
FIG. 7B2
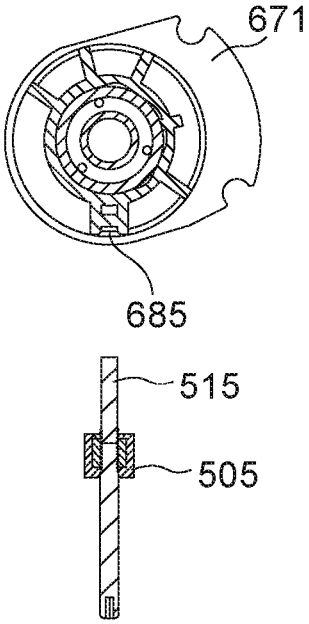

IMAGE FORMING APPARATUS HAVING OPTICAL PRINT HEAD

BACKGROUND OF THE INVENTION

Field of the Invention

The present invention relates to an image forming apparatus having a movement mechanism that moves an optical print head from a position retracted from a drum unit, toward the drum unit.

Description of the Related Art

Image forming apparatuses such as printers, copying machines, and so forth, have an optical print head that has multiple light-emitting elements for exposing a photosensitive drum. Some optical print heads use light-emitting diodes (LEDs) or organic electroluminescence (EL) devices or the like, which are examples of light-emitting elements. There are known arrangements where multiple such light-emitting elements are arrayed in one row or two staggered rows, for example, in the rotational axis direction of the photosensitive drum. Optical print heads also have multiple lenses for condensing light emitted from the multiple light-emitting elements onto the photosensitive drum. The multiple lenses are disposed facing the surface of the photosensitive drum, having been arrayed in the direction of array of the light-emitting elements, between the multiple light-emitting elements and the photosensitive drum. Light emitted from the multiple light-emitting elements is condensed on the surface of the photosensitive drum through the lenses, and an electrostatic latent image is formed on the photosensitive drum.

The photosensitive drum is a consumable item, and accordingly is periodically replaced. A worker performing the work of replacing a photosensitive drum or the like can perform maintenance of the image forming apparatus by replacing the drum unit containing the photosensitive drum. The drum unit has a configuration where it is detachably mountable to a main body of the image forming apparatus, by being extracted from and inserted to the apparatus main body from the side face of the image forming apparatus by sliding movement. The clearance between the lenses and the surface of the photosensitive drum is extremely narrow at an exposure position of the optical print head for when exposing the photosensitive drum (a position near to and facing the surface of the drum). Accordingly, the optical print head needs to be retracted from the exposure position when replacing the drum unit, lest the optical print head and photosensitive drum or the like come into contact and the surface of the photosensitive drum and the lenses be damaged. Accordingly, a mechanism needs to be provided where the optical print head is reciprocally moved between the exposure position and a retracted position where the optical print head is further distanced from the surface of the drum unit than the exposure position, in order to mount/detach the drum unit.

Japanese Patent Laid-Open No. 2013-134370 discloses a mechanism for moving the optical print head (LED array 50) between the exposure position and retracted position. An LED unit 12 disclosed in FIG. 2 of Japanese Patent Laid-Open No. 2013-134370 includes the LED array 50, a first frame 51 that supports the LED array 50, and a movement mechanism 60 for moving the LED array 50 to an exposure position and a retracted position. The LED array 50 is supported by the first frame 51. The first frame 51 has two positioning rollers 53 on both end sides thereof in the longitudinal direction, that face a photosensitive drum 15. At each of the both end sides of the first frame 51, one end of a compression spring 54 is attached to the side thereof opposite to the side to which the photosensitive drum 15 is disposed. The other end of each of these compression springs 54 is attached to the respective end sides in the longitudinal direction of a holding member 63. The holding member 63 is disposed on the opposite side of the first frame 51 as to the side where the photosensitive drum 15 is disposed. That is to say, the first frame 51 is supported by the holding member 63 via the compression springs 54. The first frame 51 is movable in a direction of reciprocally moving between the exposure position and the retracted position.

The movement mechanism 60 is disposed on the opposite side of the LED array 50 from which the side where the photosensitive drum 15 is disposed, and includes a holding member 63, a sliding member 61 that moves by sliding in the rotational axis direction of the photosensitive drum 15, and moving members 62. The moving members 62 are made up of a front-side moving member 62F and a rear-side moving member 62R, as illustrated in FIG. 2 of Japanese Patent Laid-Open No. 2013-134370. The front-side moving member 62F and rear-side moving member 62R each have a first link portion 85 and a second link portion 89, respectively.

The front-side moving member 62F will be described below. The first link portion 85 and second link portion 89 are connected so as to be capable of relative rotation on a shaft portion 95 as the center of pivoting, making up a pantograph configuration, as described above. One end side of the first link portion 85 in the longitudinal direction is pivotably connected as to the sliding member 61, and moves in the front-and-rear directions while turning within a main-body-side guide portion 99 that is fixed to the main body, in conjunction with sliding movement of the sliding member 61. The other end side of the first link portion 85 in the longitudinal direction is turnably connected to a fitting hole 106 provided to the holding member 63. One end side of the second link portion 89 in the longitudinal direction is turnably connected to a main-body-side fitting portion 100 fixed to the main body. The other end side of the second link portion 89 in the longitudinal direction is turnably connected to a guide hole 105 provided to the holding member 63, and also connected so as to be movable in the front-and-rear direction. The rear-side moving member 62R also has the same configuration.

According to the above configuration, sliding movement of the sliding member 61 causes the holding member 63 to reciprocally move between the exposition position and the retracted position. The movement of the holding member 63 causes the first frame 51 and LED array 50 to also reciprocally move between the exposition position and the retracted position. When the first frame 51 moves from the retracted position toward the exposure position, the positioning rollers 53 come into contact with the photosensitive drum 15, and the compression springs 54 are compressed. The restoring force of the compressed compression springs 54 biases the positioning rollers 53 toward the photosensitive drum 15, and the LED array 50 is situated at the exposure position by a gap being formed between the photosensitive drum 15 and LED array 50.

However, the pantograph mechanism (moving members 62) described in Japanese Patent Laid-Open No. 2013-134370 is a complicated mechanism. Assembly of the moving members 62 requires at least (1) a process of linking the first link portions 85 and second link portions 89 to the holding member 63, (2) a process of linking the first link portions 85 and second link portions 89 to each other, and (3) a process of linking the first link portions 85 and second link portions 89 to the sliding member 61. Having a great number of processes of linking various types of members with each other, is a factor that leads to increase in assembly time.

Accordingly, a mechanism will be considered wherein the second link portion 89 is omitted from the front-side moving member 62F and rear-side moving member 62R, i.e., a mechanism where there is one link portion to the first side of the movement mechanism 60, and one to the rear side. However, this mechanism only has one link portion at each of the front side and rear side of the movement mechanism 60, so the holding member 63 also moves by sliding in the front-and-rear direction along with the sliding movement of the sliding member 61, and the holding member may not move in the direction of reciprocally moving between the exposure position and the retracted position.

SUMMARY OF THE INVENTION

An image forming apparatus according to an aspect of the present invention includes a photosensitive drum, an optical print head configured to expose the photosensitive drum, and a movement mechanism configured to move the optical print head situated at a retracted position of being retracted from the photosensitive drum, to an exposure position that is closer to the photosensitive drum than the retracted position, to expose the photosensitive drum. The movement mechanism includes a sliding portion configured to be capable of sliding movement from one end side of the optical print head in the longitudinal direction of the optical print head to another end side of the optical print head in the longitudinal direction of the optical print head, a first link portion configured to form a first connecting portion by one end side thereof being pivotably connected to one end side of the sliding portion in the longitudinal direction, and form a second connecting portion by another end side thereof being pivotably connected to one end side of the optical print head in the longitudinal direction, with the second connecting portion being situated further at a downstream side in the direction of sliding movement, which is the side where the photosensitive drum is situated, than the first connecting portion, a second link portion configured to form a third connecting portion by one end side thereof being pivotably connected to another end side of the sliding portion in the longitudinal direction, and form a fourth connecting portion by another end side thereof being pivotably connected to another end side of the optical print head in the longitudinal direction, with the fourth connecting portion being situated further at a downstream side in the direction of sliding movement, which is the side where the photosensitive drum is situated, than the third connecting portion, and an abutting portion which the optical print head abuts in the direction of sliding movement, to restrict movement in the direction of sliding movement of the optical print head in conjunction with the sliding movement of the sliding portion, the first link portion and the second link portion being caused to pivot in conjunction with the sliding movement of the sliding portion, to move the optical print head from the retracted position toward the exposure position.

An image forming apparatus according to another aspect of the present invention includes a photosensitive drum, an optical print head configured to expose the photosensitive drum, and a movement mechanism configured to move the optical print head situated at a retracted position of being retracted from the photosensitive drum, to an exposure position that is closer to the photosensitive drum than the retracted position, to expose the photosensitive drum. The movement mechanism includes a sliding portion configured to be capable of sliding movement from another end side of the optical print head in the longitudinal direction of the optical print head to one end side of the optical print head in the longitudinal direction of the optical print head, a first link portion configured to form a first connecting portion by one end side thereof being pivotably connected to one end side of the sliding portion in the longitudinal direction, and form a second connecting portion by another end side thereof being pivotably connected to one end side of the optical print head in the longitudinal direction, with the second connecting portion being situated further at a downstream side in the direction of sliding movement, which is the side where the photosensitive drum is situated, than the first connecting portion, a second link portion configured to form a third connecting portion by one end side thereof being pivotably connected to another end side of the sliding portion in the longitudinal direction, and form a fourth connecting portion by another end side thereof being pivotably connected to another end side of the optical print head in the longitudinal direction, with the fourth connecting portion being situated further at a downstream side in the direction of sliding movement, which is the side where the photosensitive drum is situated, than the third connecting portion, and an abutting portion which the optical print head abuts in the direction of sliding movement, to restrict movement in the direction of sliding movement of the optical print head in conjunction with the sliding movement of the sliding portion, the first link portion and the second link portion being caused to pivot in conjunction with the sliding movement of the sliding portion, to move the optical print head from the retracted position toward the exposure position.

Further features of the present invention will become apparent from the following description of exemplary embodiments with reference to the attached drawings.

BRIEF DESCRIPTION OF THE DRAWINGS

FIGS. 5A through 5C2 are schematic diagrams for describing a circuit board, LED chips, and lens array of an optical print head.

FIGS. 7A1 through 7B2 are diagrams illustrating a state where an optical print head is in contact with a drum unit, and a retracted state.

DESCRIPTION OF THE EMBODIMENTS

Embodiment

Image Forming Apparatus

Figure 1:
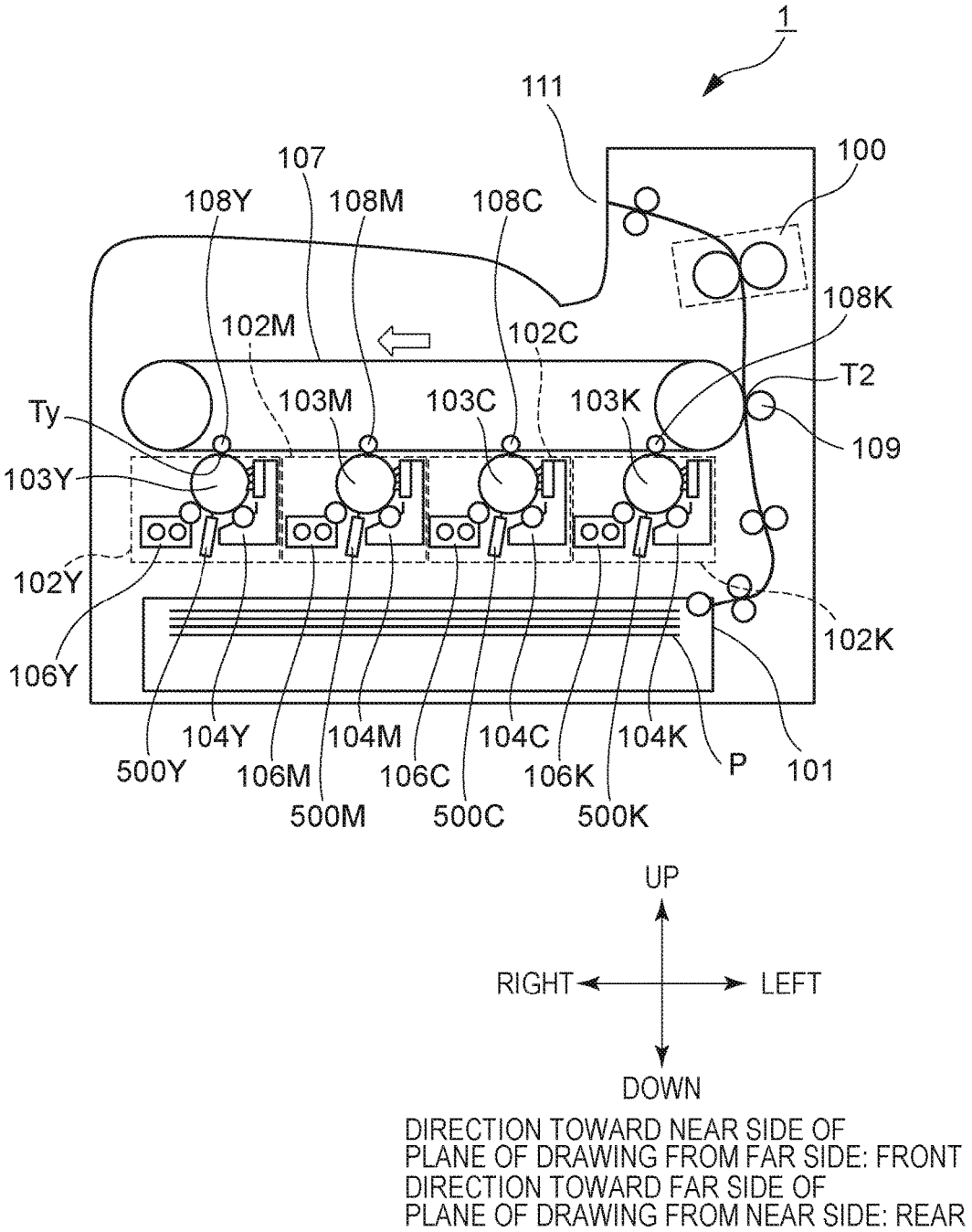
FIG. 1 is a schematic cross-sectional diagram of an image forming apparatus.

First, a schematic configuration of an image forming apparatus 1 will be described. FIG. 1 is a schematic cross-sectional view of the image forming apparatus 1. Although the image forming apparatus 1 illustrated in FIG. 1 is a color printer that does not have a reader, an embodiment may be a copying machine that has a reader. Also, an embodiment is not restricted to a color image forming apparatus having multiple photosensitive drums 103 as illustrated in FIG. 1, and may be a color image forming apparatus having one photosensitive drum 103 or an image forming apparatus that forms monochromatic images.

The image forming apparatus 1 illustrated in FIG. 1 has four image forming units 102Y, 102M, 102C, and 102K (hereinafter also collectively referred to simply as "image forming unit 102") that form toner images of the yellow, magenta, cyan, and black colors. The image forming units 102Y, 102M, 102C, and 102K respectively have a photosensitive drum 103Y, 103M, 103C, and 103K (hereinafter also collectively referred to simply as "photosensitive drum 103"). The image forming units 102Y, 102M, 102C, and 102K also respectively have a charger 104Y, 104M, 104C, and 104K (hereinafter also collectively referred to simply as "charger 104") for charging the photosensitive drums 103Y, 103M, 103C, and 103K. The image forming units 102Y, 102M, 102C, and 102K further respectively have a light-emitting diode (LED) exposing unit 500Y, 500M, 500C, and 500K (hereinafter also collectively referred to simply as "LED exposing unit 500") serving as an exposure light source that emits light to expose the photosensitive drums 103Y, 103M, 103C, and 103K. Moreover, the image forming units 102Y, 102M, 102C, and 102K respectively have a developing unit 106Y, 106M, 106C, and 106K (hereinafter also collectively referred to simply as "developing unit 106") that develops electrostatic latent images on the photosensitive drum 103 by toner, thereby developing toner images of the respective colors on the photosensitive drums 103. The Y, M, C, and K appended to the reference numerals indicate the color of the toner.

The image forming apparatus 1 is provided with an intermediate transfer belt 107 onto which toner images formed on the photosensitive drums 103 are transferred, and primary transfer rollers 108Y, 108M, 108C, and 108K that sequentially transfer the toner images formed on the photosensitive drums 103 of the image forming units 102 onto the intermediate transfer belt 107. The image forming apparatus 1 further is provided with a secondary transfer roller 109 that transfers the toner image on the intermediate transfer belt 107 onto a recording sheet P conveyed from a sheet feed unit 101, and a fixing unit 100 that fixes the secondary-transferred image onto the recording sheet P.

Drum Unit

Figure 2A:
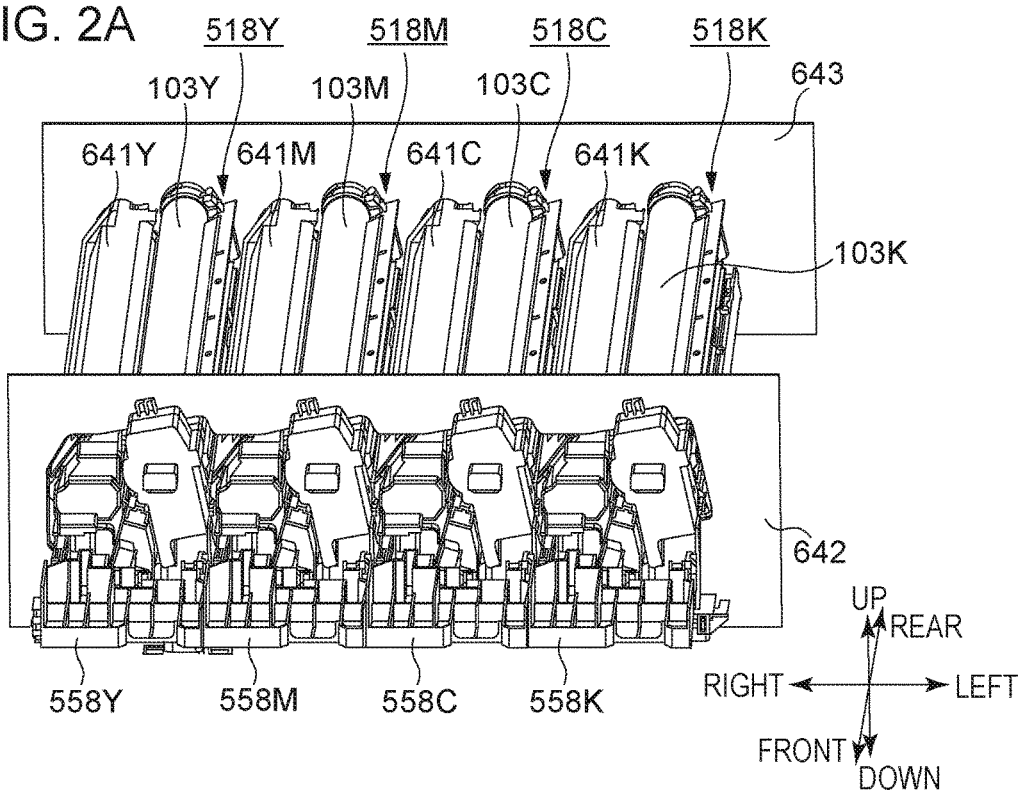
FIGS. 2A and 2B are perspective views of around drum units in the image forming apparatus.
Figure 2B:
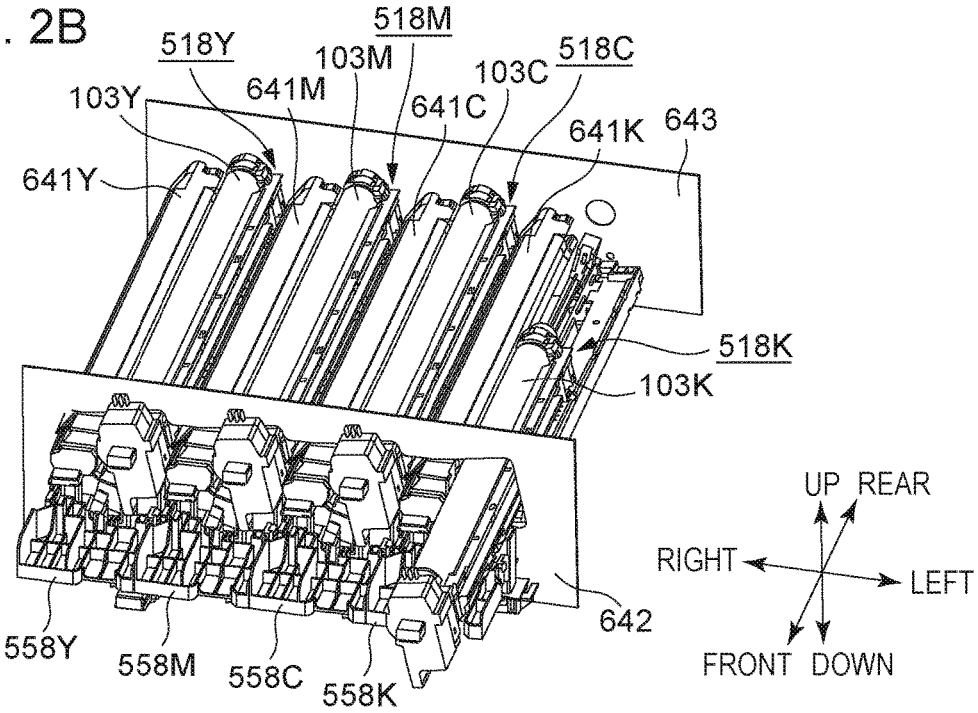

Next, drum units 518Y, 518M, 518C, and 518K, and developing units 641Y, 641M, 641C, and 641K, which are an example of replacement units detachably mounted to the image forming apparatus 1 according to the present embodiment, will be described. FIG. 2A is a schematic perspective view around the drum units 518 and developing units 641 that the image forming apparatus 1 has. FIG. 2B is a diagram illustrating a drum unit 518 partially inserted into the image forming apparatus 1 from the outer side of the apparatus main body.

The image forming apparatus 1 has a front-side plate 642 and a rear-side plate 643 that are formed from sheet metal, as illustrated in FIG. 2A. The front-side plate 642 is a side wall provided to the front side of the image forming apparatus 1. The rear-side plate 643 is a side wall provided to the rear side of the image forming apparatus 1. The front-side plate 642 and rear-side plate 643 are disposed facing each other as illustrated in FIG. 2A, with sheet metal serving as beams that are omitted from illustration crossing therebetween. The front-side plate 642, rear-side plate 643, and unshown beams make up part of a frame of the image forming apparatus 1.

Openings are formed on the front-side plate 642, through which the drum units 518 and developing units 641 can be inserted and extracted from the front side of the image forming apparatus 1. The drum units 518 and developing units 641 are mounted through openings to predetermined positions in the main unit of the image forming apparatus 1 (mounting positions). The image forming apparatus 1 also has covers 558 that cover the front side of the drum units 518 and developing units 641 that have been mounted to their mounting positions. The covers 558 have one end thereof fixed integrally to the main body of the image forming apparatus 1 by a hinge, and are capable of pivoting as to the main body of the image forming apparatus 1 on the hinge. Unit replacement work is completed by a worker who performs maintenance opening a cover 558 and extracting a drum unit 518 or developing unit 641 within the main body, inserting a new drum unit 518 or developing unit 641, and closing the cover 558. The covers 558 will be described in detail later.

In the following description, the front-side plate 642 side of the image forming apparatus 1 is defined as the front side, and the rear-side plate 643 side as the rear side, as illustrated in FIGS. 2A and 2B. The side where the photosensitive drum 103Y that forms electrostatic latent images relating to yellow toner images is disposed is defined as the right side, with the photosensitive drum 103K that forms electrostatic latent images relating to black toner images as a reference. The side where the photosensitive drum 103K that forms electrostatic latent images relating to black toner images is disposed is defined as the left side, with the photosensitive drum 103Y that forms electrostatic latent images relating to yellow toner images as a reference. Further, a direction that is perpendicular to the front-and-rear directions and left-and-right directions defined here, and is upward in the vertical direction is defined as the upward direction, and a direction that is perpendicular to the front-and-rear directions and left-and-right directions defined here, and is downward in the vertical direction is defined as the downward direction. The defined front direction, rear direction, right direction, left direction, upward direction, and downward direction, as illustrated in FIGS. 2A and 2B. The term "one end side of the photosensitive drum 103 in the rotational axis direction" as used in the present specification means the front side as defined here. The term "other end side of the photosensitive drum 103 in the rotational axis direction" as used in the present specification means the rear side as defined here. The one end side and other end side in the front-and-rear direction here also correspond to the front side and rear side defined here. The one end side in the left-and-right direction means the right side as defined here, and the other end side means the left side as defined here.

Drum units 518 are attached to the image forming apparatus 1 according to the present embodiment. The drum units 518 are cartridges that are replaced. The drum units 518 according to the present embodiment have photosensitive drums 103 rotatably supported as to the casing of the drum units 518. The drum units 518 each have a photosensitive drum 103, charger 104, and cleaning device that is omitted from illustration. When the lifespan of a photosensitive drum 103 is expended due to wear by cleaning by the cleaning device for example, a worker who performs maintenance extracts the drum unit 518 from the apparatus main body, and replaces the photosensitive drum 103, as illustrated in FIG. 2B. Note that a configuration may be made where the drum unit 518 includes neither the charger 104 nor cleaning device, and only includes the photosensitive drum 103.

The developing units 641, which are separate from the drum units 518, are attached to the image forming apparatus 1 according to the present embodiment. The developing units 641 include the developing units 106 illustrated in FIG. 1. Each developing unit 106 is provided with a developing sleeve serving as a developing agent bearing member that bears a developing agent. Each developing unit 641 is provided with multiple gears for rotating a screw that agitates the toner and a carrier. When these gears deteriorate due to age or the like, a worker extracts the developing unit 641 from the apparatus main body of the image forming apparatus 1 and replaces it. The developing unit 641 according to the present embodiment is a cartridge where a developing unit 106 having a developing sleeve, and a toner container in which a screw is provided, have been integrated. An embodiment of the drum unit 518 and developing unit 641 may be a process cartridge where the drum unit 518 and developing unit 641 are integrated.

Image Forming Process

Next, an image forming process will be described. A later-described optical print head 105Y exposes the surface of the photosensitive drum 103Y that has been charged by the charger 104Y. Accordingly, an electrostatic latent image is formed on the photosensitive drum 103Y. Next, the developing unit 106Y develops the electrostatic latent image formed on the photosensitive drum 103Y by yellow toner. The yellow toner image developed on the surface of the photosensitive drum 103Y is transferred onto the intermediate transfer belt 107 by the primary transfer roller 108 at a primary transfer position Ty. Magenta, cyan, and black toner image are also transferred onto the intermediate transfer belt 107 by the same image forming process.

The toner images of each color transferred onto the intermediate transfer belt 107 are conveyed to a secondary transfer position T2 by the intermediate transfer belt 107. Transfer bias for transferring the toner images onto a recording sheet P is applied to the secondary transfer roller 109 disposed at the secondary transfer position T2. The toner images conveyed to the secondary transfer position T2 are transferred onto a recording sheet P conveyed from the sheet feed unit 101 by the transfer bias of the secondary transfer roller 109. The recording sheet P onto which the toner images have been transferred is conveyed to the fixing unit 100. The fixing unit 100 fixes the toner images onto the recording sheet P by heat and pressure. The recording sheet P subjected to fixing processing by the fixing unit 100 is discharged to a sheet discharge unit 111.

Exposing Unit

Figure 3:
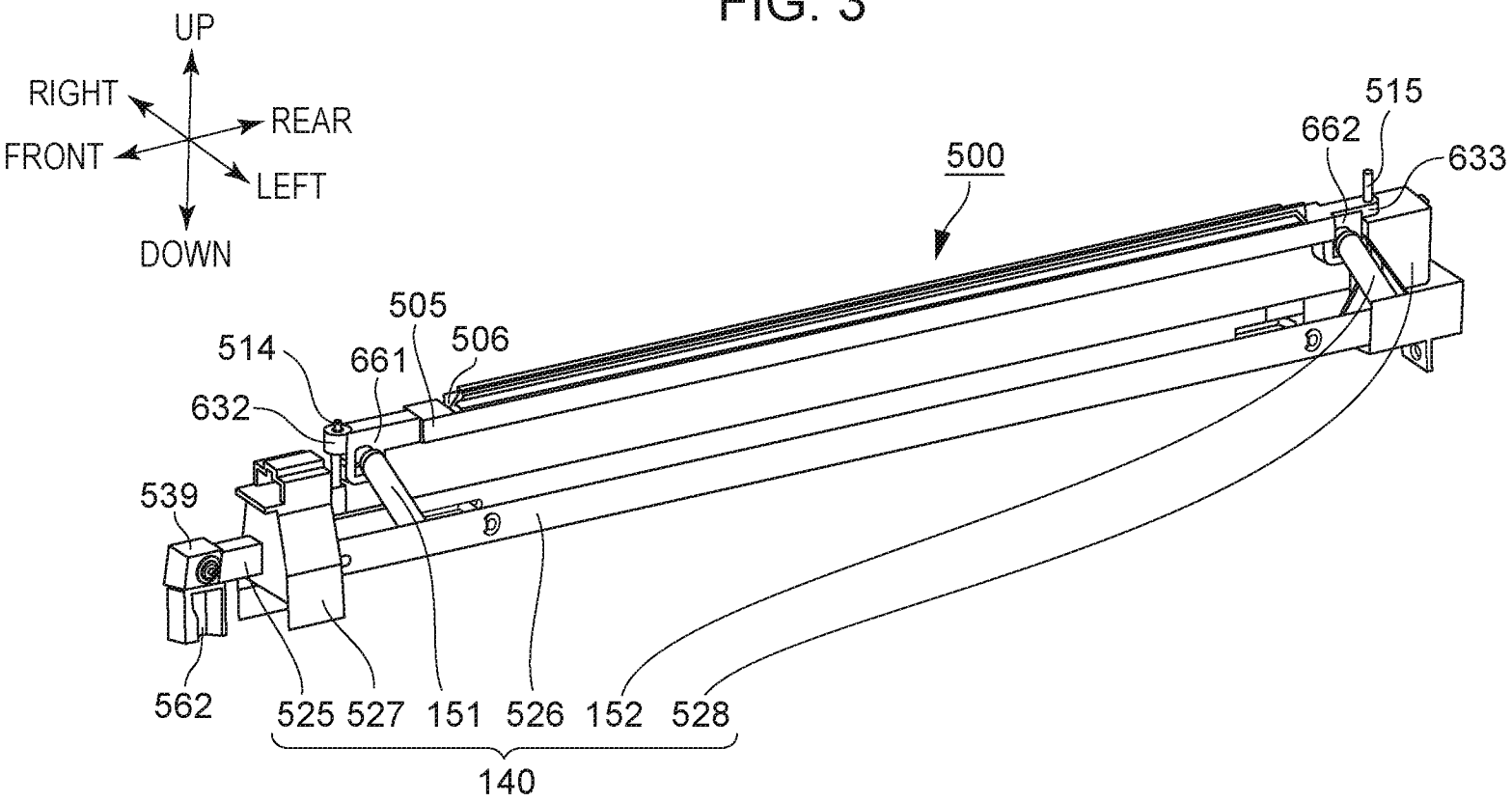
FIG. 3 is a schematic perspective view of an exposing unit.
Figure 4:
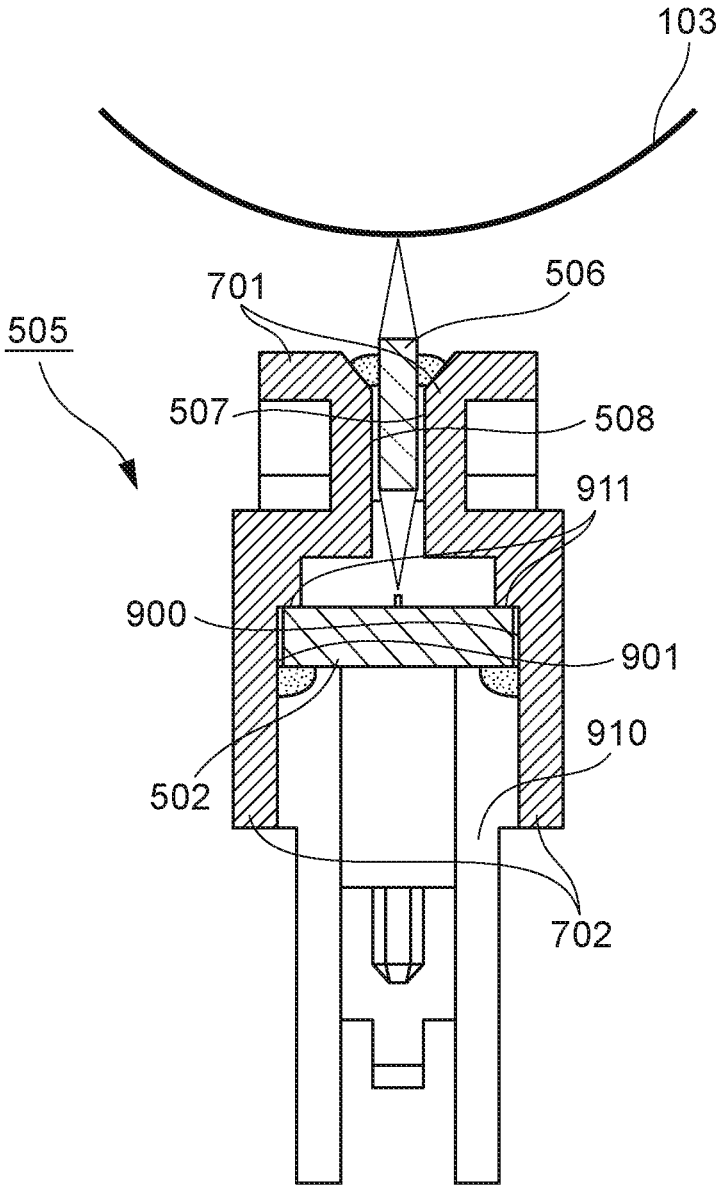
FIG. 4 is a cross-sectional view of an optical print head, taken along a direction perpendicular to a rotational axis of a photosensitive drum.

The exposing unit 500 including the optical print head 105 will be described next. Laser beam scanning exposure, where an emitted semiconductor laser beam is scanned using a polygon mirror or the like and the photosensitive drum is exposed via an F-theta lens or the like is known as one example of an exposing method employed in electrophotographic image forming apparatuses. The "optical print head 105" described in the present embodiment is used in LED exposure where light-emitting elements such as LEDs or the like arrayed following the rotational axis direction of the photosensitive drum 103 are used to expose the photosensitive drum 103, but is not used in the above-described laser beam scanning exposure. FIG. 3 is a schematic perspective view of the exposing unit 500 that the image forming apparatus 1 has. FIG. 4 is a cross-sectional schematic diagram where the exposing unit 500 illustrated in FIG. 3, and the photosensitive drum 103 disposed to the upper side of the exposing unit 500, have been cut away on a plane perpendicular to the rotational axis direction of the photosensitive drum 103. The exposing unit 500 has the optical print head 105 and a movement mechanism 140. The optical print head 105 is provided with a holding member 505, an abutting pin 514, and an abutting pin 515. The holding member 505 holds a lens array 506 as an example of lenses, and a circuit board 502. The movement mechanism 140 has a link member 151 that is an example of a first link portion, a link member 152 that is an example of a second link portion, a sliding portion 525, a first support portion 527, a second support portion 528, and a third support portion 526. Although the abutting pin 514 and abutting pin 515 are described as being cylindrical pins in the present embodiment, the shape thereof is not restricted to being cylindrical, and may be polygonal posts, or conical shapes where the diameter is tapered toward the tip.

First, the holding member 505 will be described. The holding member 505 is a holder that holds the later-described circuit board 502, the lens array 506, and abutting pins 514 and 515. As one example in the present embodiment, the length of the abutting pin 514 protruding from the upper face of the holding member 505 is 7 mm, the length of the abutting pin 515 protruding from the upper face of the holding member 505 is 11 mm, the length of the abutting pin 514 protruding from the lower face of the holding member 505 is 22 mm, and the length of the abutting pin 515 protruding from the lower face of the holding member 505 is 22 mm. The holding member 505 is provided with lens attaching portions 701 where the lens array 506 is attached, and circuit board attaching portions 702 where the circuit board 502 is attached, as illustrated in FIG. 4. The holding member 505 also has spring attaching portions 661 and 662, and pin attaching portions 632 and 633, which will be described later with reference to FIGS. 18A through 18D. The holding member 505 is a molded resin article, where the lens attaching portion 701, circuit board attaching portion 702, spring attaching portions 661 and 662, and pin attaching portions 632 and 633 have been integrally formed by injection molding. The spring attaching portion 661 to which the link member 151 is attached is provided between the lens array 506 and the pin attaching portion 632 in the front-and-rear direction, as illustrated in FIG. 3. Also, the spring attaching portion 662 to which the link member 152 is attached is provided between the lens array 506 and the pin attaching portion 633 in the front-and-rear direction. That is to say, the holding member 505 is supported by the link member 151 between the lens array 506 and abutting pin 514 in the front-and-rear direction, and is supported by the link member 152 between the lens array 506 and abutting pin 515 in the front-and-rear direction. Portions where biasing force is applied to the holding member 505 by the link member 151 and link member 152 do not overlap the lens array 506 in the vertical direction, so warping of the lens array 506 due to this biasing force is reduced.

The lens attaching portion 701 has a first inner wall face 507 that extends in the longitudinal direction of the holding member 505, and a second inner wall face 508 that faces the first inner wall face 507 and also extends in the longitudinal direction of the holding member 505. The lens array 506 is inserted between the first inner wall face 507 and the second inner wall face 508 when assembling the optical print head 105. Adhesive agent is coated between the side face of the lens array 506 and the lens attaching portion 701, thereby fixing the lens array 506 to the holding member 505.

The circuit board attaching portion 702 has a cross-sectional open-box shape, and has a third inner wall face 900 extending in the longitudinal direction of the holding member 505, and a fourth inner wall face 901 that faces the third inner wall face 900 and extends in the longitudinal direction of the holding member 505, as illustrated in FIG. 4. A gap 910 into which the circuit board 502 is inserted is formed between the third inner wall face 900 and fourth inner wall face 901. The circuit board attaching portion 702 also includes circuit board abutting portions 911 where the circuit board 502 abuts. The circuit board 502 is inserted from the gap 910 when assembling the optical print head 105, and pressed as far as the circuit board abutting portions 911. Adhesive agent is coated on the boundary portion between the gap 910 side of the circuit board 502 and the third inner wall face 900 and fourth inner wall face 901 in a state where the circuit board 502 is abutted against the circuit board abutting portions 911, thereby fixing the circuit board 502 to the holding member 505.

The exposing unit 500 is disposed on the lower side in the vertical direction from the rotational axis of the photosensitive drum 103, and LEDs 503 that the optical print head 105 has expose the photosensitive drum 103 from below. A configuration may be made where the exposing unit 500 is provided to the upper side in the vertical direction from the rotational axis of the photosensitive drum 103, and the LEDs 503 that the optical print head 105 has expose the photosensitive drum 103 from above.

Next, the circuit board 502 held by the holding member 505 will be described. FIG. 5A is a schematic perspective diagram of the circuit board 502. FIG. 5B1 illustrates an array of multiple LEDs 503 provided to the circuit board 502, and FIG. 5B2 is an enlarged view of FIG. 5B1.

LED chips 639 are mounted on the circuit board 502. The LED chips 639 are mounted on one face of the circuit board 502, while a connector 504 is provided to the rear face side, as illustrated in FIG. 5A. The circuit board 502 is provided with wiring to supply signals to the LED chip 639. One end of a flexible flat cable (FFC) that is omitted from illustration is connected to the connector 504. A circuit board is provided to the main unit of the image forming apparatus 1. The circuit board has a control unit and connector. The other end of the FFC is connected to this connector. Control signals are input to the circuit board 502 from the control unit of the main body of the image forming apparatus 1 via the FFC and connector 504. The LED chip 639 are driven by the control signals input to the circuit board 502.

The LED chips 639 mounted on the circuit board 502 will be described in further detail. Multiple (29) LED chips 639-1 through 639-29, on which multiple LEDs 503 are arrayed, are arrayed on one face of the circuit board 502, as illustrated in FIGS. 5B1 and 5B2. Each of the LED chips 639-1 through 639-29 has 516 LEDs (light-emitting elements) arrayed in a single row in the longitudinal direction thereof. The center-to-center distance k2 between LEDs adjacent in the longitudinal direction in the LED chips 639 corresponds to the resolution of the image forming apparatus 1. The resolution of the image forming apparatus 1 according to the present embodiment is 1200 dpi, so the LEDs are arrayed in a single row so that the center-to-center distance k2 between adjacent LEDs in the longitudinal direction of the LED chips 639-1 through 639-29 is 21.16 μm. Accordingly, the range of exposure of the optical print head 105 according to the present embodiment is 316 mm. The photosensitive layer of the photosensitive drum 103 is formed 316 mm or wider. The long side of an A4-size recording sheet and the short side of an A3-size recording sheet are 297, so the optical print head 105 according to the present embodiment has an exposing range capable of forming images on A4-size recording sheets and A3-size recording sheets.

The LED chips 639-1 through 639-29 are alternately arrayed to form two rows in the rotational axis direction of the photosensitive drum 103. That is to say, odd-numbered LED chips 639-1, 639-3, and so on through 639-29, are arrayed on one line in the longitudinal direction of the circuit board 502 from the left, and even-numbered LED chips 639-2, 639-4, and so on through 639-28, are arrayed on one line in the longitudinal direction of the circuit board 502, as illustrated in FIG. 5B1. Arraying the LED chips 639 in this way enables the center-to-center distance k1 between the LEDs disposed on one end of one LED chip 639 and the other end of another LED chip 639 among different adjacent LED chips 639 to be equal to the center-to-center distance k2 of LEDs on the same LED chip 639, in the longitudinal direction of the LED chips 639, as illustrated in FIG. 5B2.

An example where the exposing light source is configured using LEDs is described in the present embodiment. However, organic electroluminescence (EL) devices may be used instead for the exposing light source.

Next, the lens array 506 will be described. FIG. 5C1 is a schematic diagram viewing the lens array 506 from the photosensitive drum 103 side. FIG. 5C2 is a schematic perspective view of the lens array 506. These multiple lenses are arrayed in two rows following the direction of array of the multiple LEDs 503, as illustrated in FIG. 5C1. The lenses are disposed in a staggered manner such that each lens in one row comes into contact with two lenses in the other row that are adjacent in the direction of array of the lenses. The lenses are cylindrical glass rod lenses. Note that the material of the lenses is not restricted to glass, and that plastic may be used. The shape of the lenses is not restricted to a cylindrical shape either, and may be polygonal posts such as hexagonal posts or the like, for example.

A dotted line Z in FIG. 5C2 indicates the optical axis of a lens. The optical print head 105 is moved by the above-described movement mechanism 140 in a direction generally following the optical axis of the lens indicated by the dotted line Z. The term optical axis of the lenses here means a line that connects the center of the light emitting face of the lens and the focal point of this lens. The discharged light emitted from an LED enters a lens included in the lens array 506, as illustrated in FIG. 4. The lens functions to condense the discharged light entering the lens onto the surface of the photosensitive drum 103. The attachment position of the lens array 506 as to the lens attaching portion 701 is adjusted when assembling the optical print head 105, such that the distance between the light-emitting face of the LED and incoming light face of the lens, and the distance between the light-emitting face of the lens and the surface of the photosensitive drum 103, are generally equal.

Figure 6A:
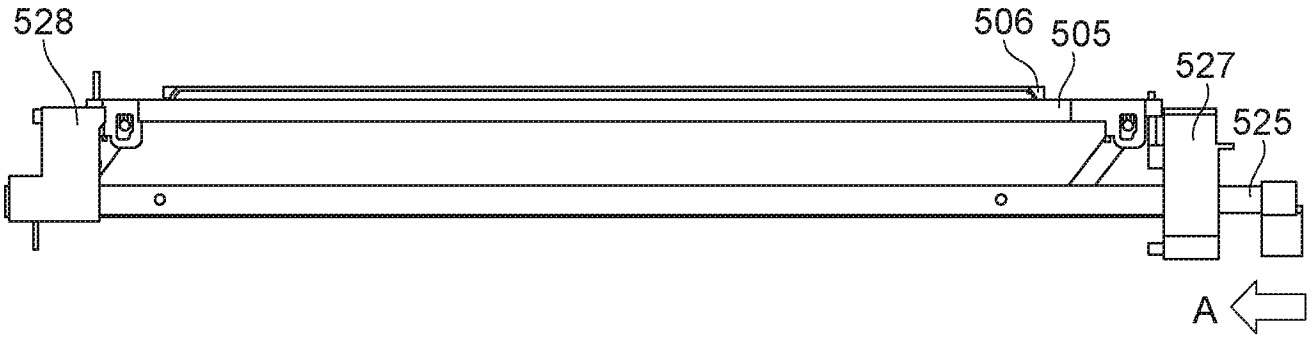
FIGS. 6A and 6B are side views of an optical print head.
Figure 6B:
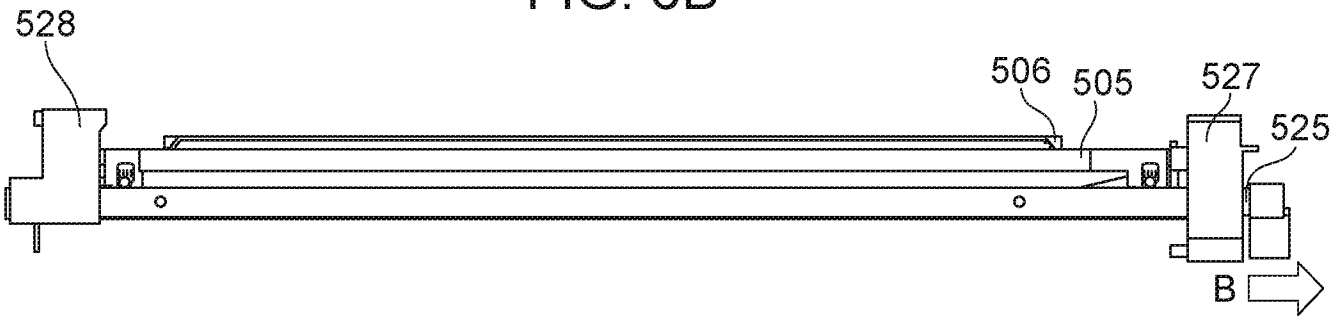

Now, the necessity of moving the optical print head 105 will be described. When replacing a drum unit 518 in the image forming apparatus 1 according to the present embodiment, the drum unit 518 is moved by sliding in the rotational axis direction of the photosensitive drum 103 to the front side of the apparatus main body, as illustrated in FIG. 2B. Moving the drum unit 518 in a state where the optical print head 105 is situated near the surface of the photosensitive drum 103 results in the drum unit 518 coming into contact with the surface of the photosensitive drum 103 while moving by sliding, and the surface of the photosensitive drum 103 being mounted will be scratched. Also, the lens array 506 will come into contact with the frame of the drum unit 518 and the lens array 506 will be scratched. Accordingly, a configuration is necessary where the optical print head 105 is reciprocally moved between a retracted position (FIG. 6B) retracted away from the photosensitive drum 103, and an exposure position nearer to the photosensitive drum 103 than the retracted position so as to expose the photosensitive drum 103 (FIG. 6A). When the sliding portion 525 moves by sliding in the direction of arrow A with the optical print head 105 at the exposure position (FIG. 6A), the optical print head 105 moves in a direction toward the retracted position (FIG. 6B). On the other hand, when the sliding portion 525 moves by sliding in the direction of arrow B with the optical print head 105 at the retracted position (FIG. 6A), the optical print head 105 moves in a direction toward the exposure position (FIG. 6A). This will be described in detail later.

FIG. 7A1 is a perspective view illustrating a bushing 671 provided to the rear side of the optical print head 105 situated in the exposure position and the rear side of the drum unit 518. FIG. 7A2 is a cross-sectional view illustrating the bushing 671 provided to the rear side of the optical print head 105 situated in the exposure position and the rear side of the drum unit 518. FIG. 7B1 is a perspective view illustrating the bushing 671 provided to the rear side of the optical print head 105 situated in the retracted position and the rear side of the drum unit 518. FIG. 7B2 is a cross-sectional view illustrating the bushing 671 provided to the rear side of the optical print head 105 situated in the retracted position and the rear side of the drum unit 518.

The way in which the abutting pin 515 provided to the rear side of the optical print head 105 abuts the bushing 671 provided to the rear side of the drum unit 518 will be described with reference to FIGS. 7A1 through 7B2. A part equivalent to the bushing 671 with which an abutting pin comes into contact is also provided on the front side of the drum unit 518, and the structure is the same as the structure of the bushing 671. Just the way in which the abutting pin 515 comes into contact with the bushing 671 provided to the rear side of the drum unit 518 will be described here.

The position at which the abutting pin 515 comes into contact with the bushing 671 provided to the rear side of the drum unit 518, and the abutting pin 514 (omitted from illustration) comes into contact with the part equivalent to the bushing 671 that is provided to the front side of the drum unit 518, is the exposure position of the optical print head 105, as illustrated in FIGS. 7A1 and 7A2. The distance between the lens array 506 and the surface of the photosensitive drum 103 becomes the designed nominal distance by the abutting pin 514 and the abutting pin 515 abutting the bushing 671 provided to the rear side of the drum unit 518 and the part equivalent to the bushing 671.

On the other hand, the position where the abutting pin 515 is retracted from the bushing 671 provided to the rear side of the drum unit 518, as illustrated in FIGS. 7B1 and 7B2 is equivalent to the retracted position of the optical print head 105. The optical print head 105 is in a state where the drum unit 518 that moves by sliding for being replaced and the optical print head 105 do not come into contact, by the optical print head 105 being at the retracted position illustrated in FIGS. 7B1 and 7B2.

Figure 8:
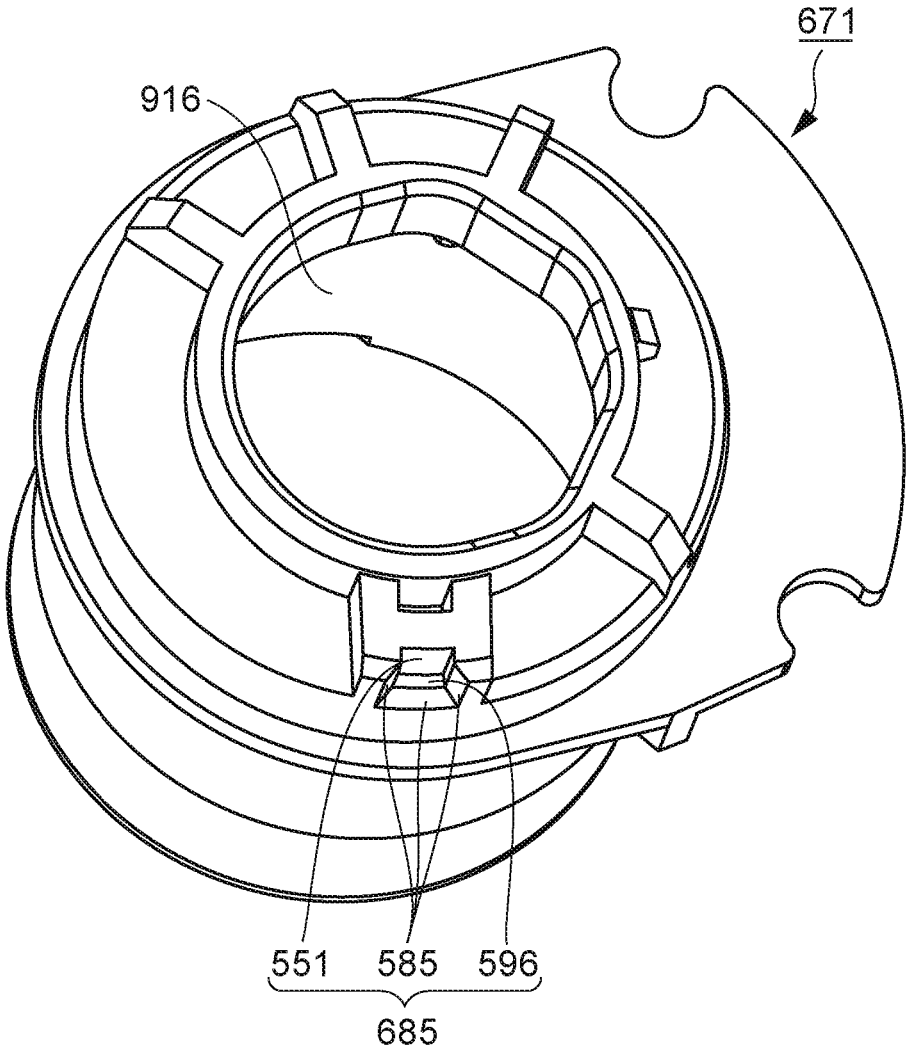
FIG. 8 is a perspective view of a bushing attached to the rear side of a drum unit.

Now, the bushing 671 that the drum unit 518 has will be described. FIG. 8 illustrates a perspective view of the bushing 671. The bushing 671 is a member fixed to the casing of the drum unit 518 by screws or adhesive agent. An opening 916 is formed in the bushing 671, as illustrated in FIG. 8. A shaft member at the other end side of the photosensitive drum 103 is rotatably inserted into the opening 916. That is to say, the bushing 671 rotatably bears the photosensitive drum 103.

The photosensitive drum 103 has a photosensitive layer formed on an outer wall face of a hollow cylindrical aluminum tube. Flanges 673 are press-fitted to both ends of the aluminum tube. The flange 673 at the other end side of the photosensitive drum 103 is rotatably inserted into the opening 916 formed in the bushing 671. The flange 673 rotates while rubbing against the inner wall face of the opening 916 formed in the bushing 671. That is to say, the bushing 671 rotatably bears the photosensitive drum 103. An opening the same as that of the bushing 671 is also formed at the middle portion of the part equivalent to the bushing 671 provided to the front side of the drum unit 518, with which the abutting pin 514 comes into contact. The flange 673 of the one end side (front side) of the photosensitive drum 103 is rotatably inserted into the opening formed in the part equivalent to the bushing 671. The flange 673 rotates while rubbing against the inner wall face of this opening. That is to say, the part equivalent to the bushing 671 rotatably bears the photosensitive drum 103 at the front side, the same as the rear side of the drum unit 518.

The bushing 671 has a fitting portion 685 to which the abutting pin 515 fits. The fitting portion 685 is provided with an abutting face 551, a rear-side wall face 596, and a tapered portion 585. The abutting pin 515 that moves in the direction from the retracted position toward the exposure position abuts the abutting face 551. The lower edge of the fitting portion 685 has the tapered portion 585 formed, that is tapered. The tapered portion 585 guides movement of the abutting pin 515 heading from the retracted position toward the exposure position, so as to abut the abutting face 551. Contact of the rear-side wall face 596 and the abutting pin 515 will be described later.

Movement Mechanism

Figure 9A:
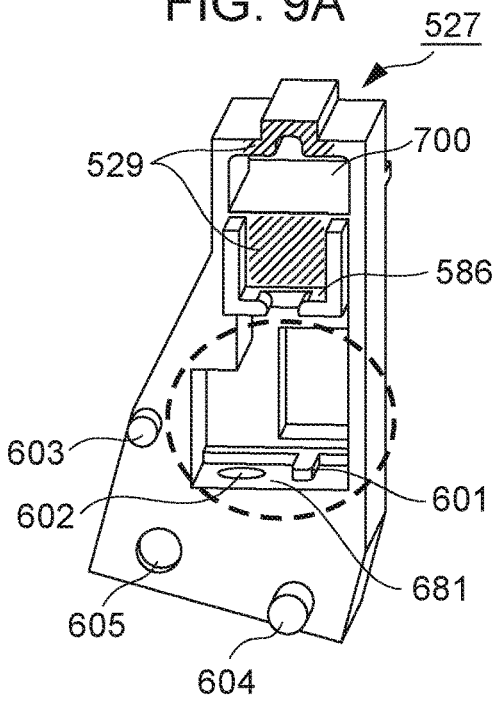
FIGS. 9A through 9C are perspective views of a first support portion and a third support portion.

The movement mechanism 140 for moving the optical print head 105 will be described next. First, the first support portion 527 will be described. FIG. 9A is a schematic perspective view of the first support portion 527. The first support portion 527 has an abutting face 586, an opening 700, an abutting portion 529, a protrusion 601, a screw hole 602, positioning bosses 603 and 604, and a screw hole 605, and is fixed to the main body of the image forming apparatus 1 as a separate member from the optical print head 105.

The abutting face 586 (an example of a seating face) is a portion that abuts the lower side of the holding member 505 (the lower side of the optical print head 105) moving from the exposure position toward the retracted position. The lower side of the holding member 505 comes into contact with the abutting face 586, and the optical print head 105 is at the retracted position.

The light-emitting face of the lens array 506 may become contaminated by toner and the like. A rod-shaped cleaning member is inserted from the outside of the main body of the image forming apparatus 1 toward the opening 700, to clean the light-emitting face. The abutting portion 529 is a rear-side face of the first support portion 527, as indicated by hatching in FIG. 9A, and is regions above and below the opening 700. The function of the abutting portion 529 will be described later in detail.

The first support portion 527 is fixed to the front-side face of the front-side plate 642. Multiple holes (omitted from illustration), corresponding to the positioning bosses 603 and 604 and fixing screws are formed in the front-side plate 642. The positioning boss 603 and positioning boss 604 are inserted into respective holes of the multiple holes provided to the front-side plate 642, and in this state, the first support portion 527 is fixed to the front-side plate 642 by screws passed through the screw holes of the first support portion 527.

Figure 9B:
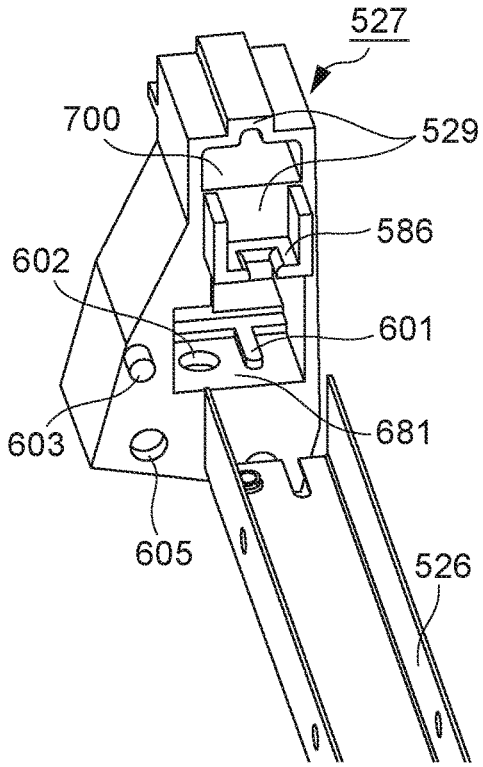
Figure 9C:
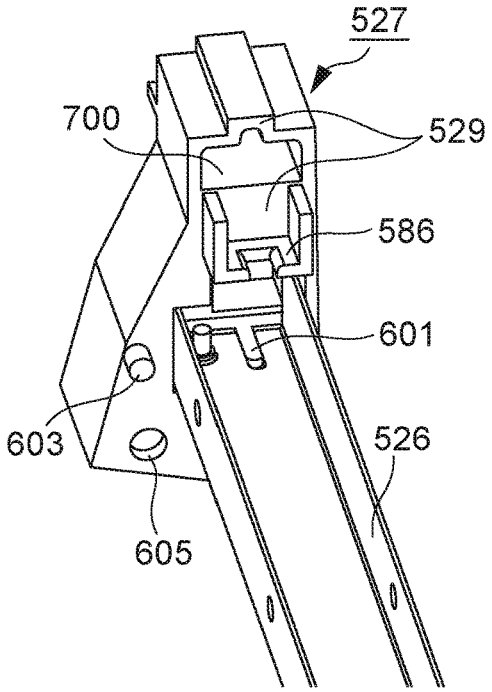

The third support portion 526, which will be described later, is sheet metal folded into the shape of a box with one end opened. FIG. 9B is a diagram for describing the way in which one end portion of the third support portion 526 in the longitudinal direction is inserted into the portion surrounded by a dotted line in FIG. 9A. FIG. 9C is a diagram illustrating the one end portion of the third support portion 526 in the longitudinal direction having been inserted into the portion surrounded by the dotted line in FIG. 9A. A notch is provided at the one end portion of the third support portion 526 as illustrated in FIGS. 9B and 9C, with the protrusion 601 of the first support portion 527 engaging the notch of the third support portion 526. This engaging of the protrusion 601 with the notch in the third support portion 526 positions the third support portion 526 as to the first support portion 527 in the left-and-right direction. The third support portion 526 is pressed from the lower side in FIG. 9C by the screw inserted from the screw hole 602. Accordingly, the third support portion 526 is fixed to the first support portion 527 by abutting a contact face 681 of the first support portion 527.

Figure 10A:
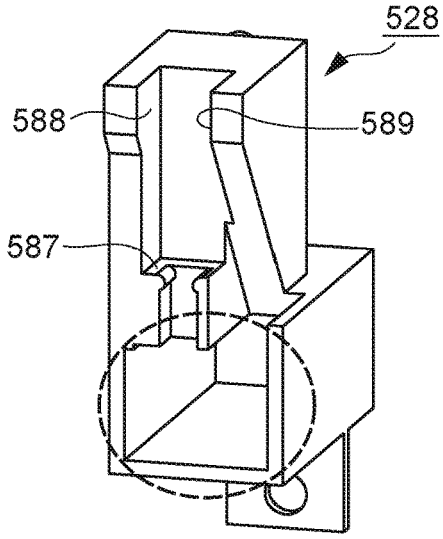
FIGS. 10A through 10C are perspective views of a second support portion, a rear-side plate, and an exposing unit attached to the second support portion.

Next, the second support portion 528 will be described. FIG. 10A is a schematic perspective view of the second support portion 528. A contact face 587 (an example of a seating face), a first wall face 588, and a second wall face 589, are formed on the second support portion 528. The contact face 587 abuts the lower side of the holding member 505 moving from the exposure position toward the retracted position. The holding member 505 that is moving from the exposure position toward the retracted position abuts the contact face 587 from the upper side in the vertical direction and stops, and thus is at the retracted position.

Figure 10B:
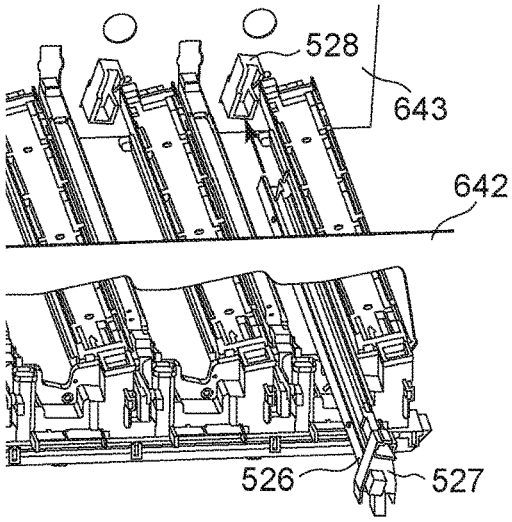
Figure 10C:
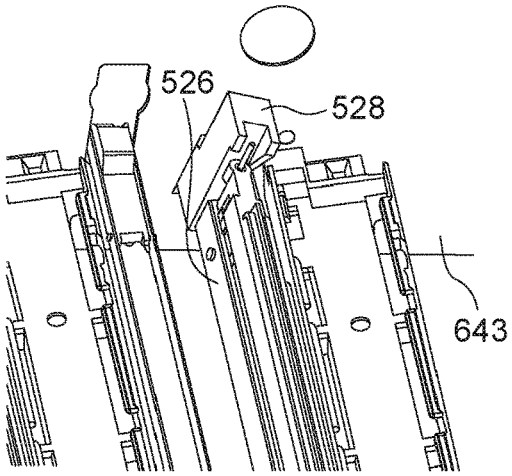

The second support portion 528 is fixed to the front-side face of the rear-side plate 643, as illustrated in FIG. 10B. The second support portion 528 is fixed to the rear-side plate 643 by positioning bosses and screws, in the same way that the first support portion 527 is fixed to the front-side plate 642. FIG. 10C illustrates a state where the other end side (rear side) of the third support portion 526 in the longitudinal direction of the third support portion 526 is inserted into the portion surrounded by a dotted line in FIG. 10A. That is to say, one end portion of the third support portion 526 is supported by the first support portion 527, and the other end portion is supported by the second support portion 528, with the first support portion 527 and the second support portion 528 being fixed to the front-side plate 642 and rear-side plate 643, respectively. In other words, the third support portion 526 is fixed to the main body of the image forming apparatus 1.

Note that an arrangement may be made where the second support portion 528 is fixed to the third support portion 526 by screws or the like, and is not fastened to the rear-side plate 643 by screws. In this case, a structure is made, for example, where a recessed portion is formed in the second support portion 528, which fits with a protruding portion formed on the rear-side plate 643, thereby positioning the second support portion 528 as to the rear-side plate 643. The first wall face 588 and second wall face 589 of the second support portion 528 will be described later.

Next, the third support portion 526 and sliding portion 525 will be described with reference to FIGS. 11A and 11B. The third support portion 526 and sliding portion 525 are disposed on the opposite side of the holding member 505 from the photosensitive drum 103.

Figure 11A:
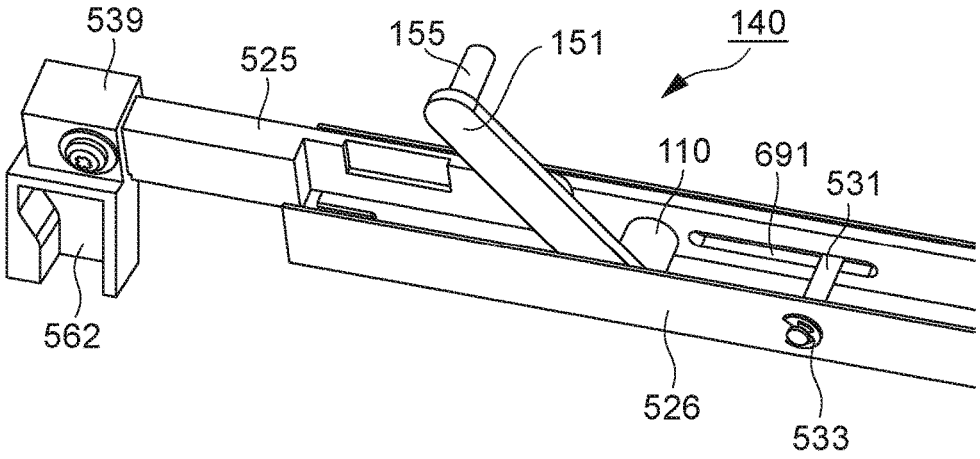
FIGS. 11A and 11B are perspective views of a movement mechanism, with the first support portion omitted from illustration.
Figure 11B:
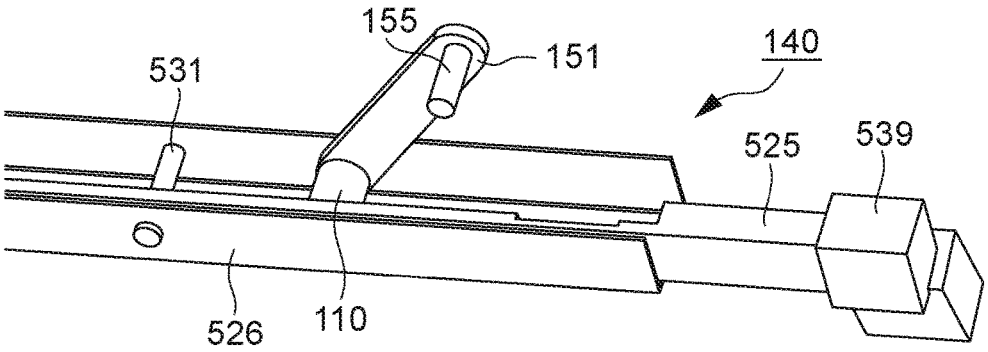

FIG. 11A is a schematic perspective view of the front side of the movement mechanism 140 as viewed from the left side, with the first support portion 527 omitted from illustration. FIG. 11B is a schematic perspective view of the front side of the movement mechanism 140 as viewed from the right side, with the first support portion 527 omitted from illustration. The movement mechanism 140 has the link member 151, the sliding portion 525, and the third support portion 526. The third support portion 526 has a support shaft 531 and an E-type snap ring 533. It can be seen from FIGS. 11A and 11B that the support shaft 531 is inserted through openings formed in the opposing faces (left-side face and right-side face) of the third support portion 526 that has been formed into the shape of a box with one side open. The support shaft 531 passes through the right-side face and the left-side face of the third support portion 526. The support shaft 531 is retained by the E-type snap ring 533 on the outer side of the left-side face, so as not to fall out from the openings of the third support portion 526. On the other hand, a slot 691 that extends in the front-and-rear direction is formed in the sliding portion 525, as illustrated in FIG. 11A. The support shaft 531 is inserted through the slot 691 of the sliding portion 525. Accordingly, movement of the sliding portion 525 in the vertical direction as to the third support portion 526 is restricted, and the sliding portion 525 can only move by sliding as to the third support portion 526 by the length of the slot 691 in the front-and-rear direction.

A slide aiding member 539 is attached to one end side of the sliding portion 525. An accommodation space 562 is provided to the slide aiding member 539, in which a later-described pressing member 561 that the cover 558 has is accommodated. The slide aiding member 539 is fixed to the sliding portion 525 by being fastened by a screw from the left side. The relation between the accommodation space 562 and the pressing member 561, and structural features thereof, will be described later along with description of the cover 558.

Figure 12A:
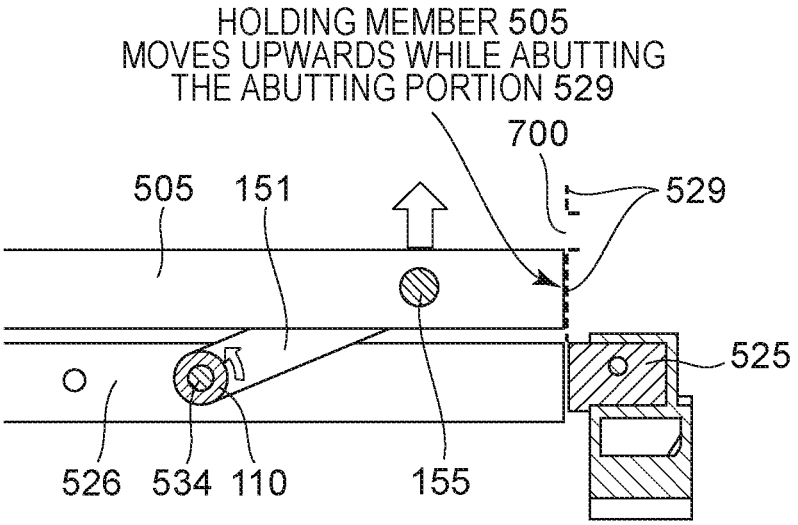
FIGS. 12A and 12B are side views illustrating a first link portion.

The arrangement by which the movement mechanism 140 moves the holding member 505 will be described with reference to FIGS. 11A through 12B. FIG. 12A is a cross-sectional view of the holding member 505 and the movement mechanism 140 illustrated in FIG. 11B, taken along the rotational axis of the photosensitive drum 103.

Figure 12B:
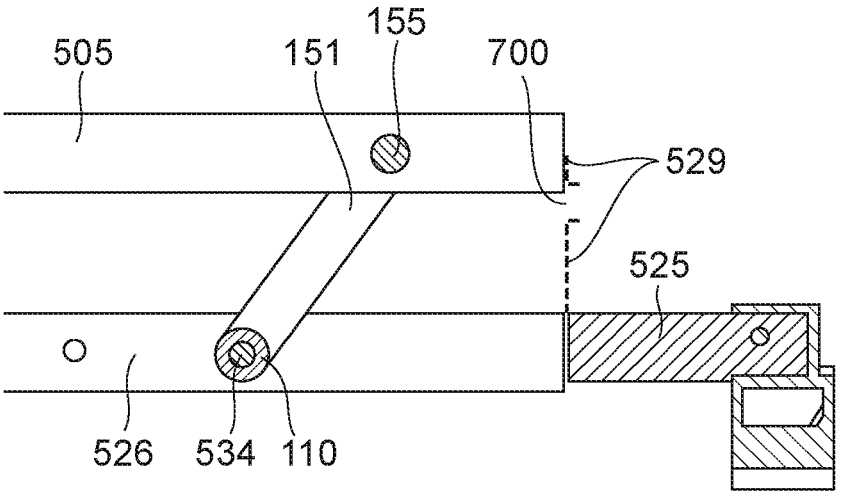

The link member 151 has a bearing 110 and a protrusion 155 serving as an example of a first moving portion, as illustrated in FIGS. 12A and 12B. The link member 151 is disposed such that the protrusion 155 is situated further downstream than the bearing 110 in the direction of sliding movement of the sliding portion 525. Note that the direction of sliding movement as used here means the direction of sliding movement of the sliding portion 525 when the optical print head 105 is moved from the retracted position toward the exposure position. The bearing 110 is provided at the one end side of the link member 151 in the longitudinal direction. The protrusion 155 is, as illustrated in FIGS. 11A and 11B, a cylindrical protrusion that is provided on the other end side of the link member 151 in the longitudinal direction and that extends in the pivoting axis direction of the link member 151. The protrusion 155 is a protrusion for deforming a spring provided on the holding member 505 side of the optical print head 105. The other end side (protrusion 155) of the link member 151 in the longitudinal direction of the link member 151 is connected to the optical print head 105, thereby forming a second connecting portion. Note that the first moving portion is not restricted to being the protrusion 155, and may be a structure where the one end side in the longitudinal direction of the link member 151 is bent in the pivoting axis direction.

A circular hollowed space that extends in the left-and-right direction is formed in the bearing 110, as a hole. A fitting shaft portion 534 is provided to the sliding portion 525, as illustrated in FIGS. 12A and 12B. the fitting shaft portion 534 is a cylindrical protrusion erected from the sliding portion 525 toward the left. The hole of the bearing 110 is fit with the fitting shaft portion 534 so as to be capable of pivoting, thereby forming a first connecting portion. In other words, the one end side of the link member 151 in the longitudinal direction of the link member 151 (the bearing 110) is connected to the one end side of the sliding portion 525 in the longitudinal direction of the sliding portion 525 (the fitting shaft portion 534), thereby forming the first connecting portion. That is to say, the link member 151 is pivotable as to the sliding portion 525, with the first connecting portion as the center of pivoting. Note that an arrangement may be made where the fitting shaft portion 534 is formed on the link member 151 side, and the bearing 110 is formed on the sliding portion 525.

Note that a shaft the same as the support shaft 531 is provided at the rear side of the third support portion 526, and a slot the same as the slot 691 is formed at the rear side of the sliding portion 525, and the structure at the rear side of the movement mechanism 140 is the same as the structure at the front side. The structure of the link member 152 serving as an example of the second link portion also is the same as the structure of the first link portion described above, with the link member 152 corresponding to the link member 151. The connecting portion of the one end side of the link member 152 in the longitudinal direction of the link member 152 and the sliding portion 525 make up a third connecting portion in correspondence with the first connecting portion, and the connecting portion of the other end side of the link member 152 in the longitudinal direction of the link member 152 and the optical print head 105 make up a fourth connecting portion. To summarize, the second connecting portion is situated downstream from the first connecting portion in the direction of sliding movement (the direction from the rear side toward the front side), on the side at which the photosensitive drum 103 is disposed, and the fourth connecting portion is situated downstream from the third connecting portion in the direction of sliding movement (the direction from the rear side toward the front side), on the side at which the photosensitive drum 103 is disposed.

The abutting portion 529 of the first support portion 527 (omitted from illustration in FIGS. 11A through 12B) is disposed further toward the front side (the downstream side when the sliding portion 525 moves from the rear side toward the front side) as compared to the one end (front-side end portion) of the holding member 505 in the rotational axis direction of the photosensitive drum 103. Accordingly, when the sliding portion 525 moves by sliding as to the third support portion 526 from the rear side to the front side, the bearing 110 to which the fitting shaft portion 534 is fit also moves by sliding as to the third support portion 526 from the rear side to the front side, along with the sliding portion 525. The holding member 505 to which the protrusion 155 is attached also attempts to move from the rear side to the front side in conjunction with this, but the one end of the holding member 505 is abutting the abutting portion 529, and accordingly movement toward the front side is restricted. In other words, the abutting portion 529 restricts the movement of the holding member 505 (optical print head 105) toward the front side by abutting the holding member 505 in the direction opposite to the direction of the sliding portion 525 moving by sliding. The link member 151 is disposed intersecting the rotational axis direction of the photosensitive drum 103 such that the one end side having the protrusion 155 (second connecting portion) is situated closer to the drum unit 518 side as compared to the other end side having the bearing 110 (first connecting portion), and accordingly pivots in a counter-clockwise direction with the fitting shaft portion 534 as the center of pivoting, as viewed from the right side as illustrated in FIG. 12A. Accordingly, the holding member 505 moves from the retracted position toward the exposure position with the one end of the holding member 505 abutting the abutting portion 529. Thus, providing the abutting portion 529 that abuts the holding member 505 when moving in the direction of the sliding portion 525 moving when sliding enables the holding member 505 to be moved from the retracted position toward the exposure position, even without providing the second link portion 89 described in Japanese Patent Laid-Open No. 2013-134370.

On the other hand, when the sliding portion 525 moves by sliding as to the third support portion 526 from the front side to the rear side, the link member 151 moves in the opposite direction as to the arrow in FIG. 12A. When the sliding portion 525 moves by sliding as to the third support portion 526 from the front side to the rear side, the bearing 110 fit to the fitting shaft portion 534 moves by sliding as to the third support portion 526 from the front side to the rear side, along with the sliding portion 525. Accordingly, the link member 151 pivots in a clockwise direction with the fitting shaft portion 534 as the center of pivoting, as viewed from the right side as illustrated in FIG. 12A. Thus, the protrusion 155 moves in a direction from the exposure position toward the retracted position. The sliding portion 525 moves from the rear side to the front side in conjunction with a closing operation of the cover 558, and moves from the front side to the rear side in conjunction with an opening operation of the cover 558, which will be described later in detail. That is to say, when the cover 558 moves from an opened state to a closed state, the holding member 505 moves in a direction from the retracted position toward the exposure position, and when the cover 558 moves from the closed state to the opened state, the holding member 505 moves in a direction from the exposure position toward the retracted position.

When the optical print head 105 moves generally in the optical axis direction, the other end (rear-side end portion) of the holding member 505 in the rotational axis direction of the photosensitive drum 103 moves within a gap formed by the first wall face 588 and the second wall face 589 of the second support portion 528. This prevents the holding member 505 from tilting in the left or right directions.

Note that the link member 151 and link member 152 may be arranged such that the other end side is situated further toward the front side than the one end side, with the abutting portion 529 situated further toward the rear side (at the downstream side of the sliding portion 525 moving from the front side to the rear side) than the other end of the holding member 505. That is to say, it is sufficient for the abutting portion 529 to be situated at the downstream side in the direction of the sliding portion 525 moving by sliding when the holding member 505 is moved from the retracted position to the exposure position. When the sliding portion 525 moves by sliding as to the third support portion 526 from the front side to the rear side, the bearing 110 to which the fitting shaft portion 534 is fit also moves by sliding as to the third support portion 526 from the front side to the rear side, along with the sliding portion 525. The holding member 505 to which the protrusion 155 is attached also attempts to move from the front side to the rear side in conjunction with this, but the other end of the holding member 505 is abutting the abutting portion 529, and accordingly movement toward the rear side is restricted. Accordingly, the link member 151 and link member 152 pivot in the clockwise direction as to the sliding portion 525 when viewing the link member 151 from the right side, and the holding member 505 moves from the retracted position toward the exposure position with the other end of the holding member 505 abutting the abutting portion 529. In this case, the cover 558 presses the sliding portion 525 from the front side toward the rear side when moving from the opened state to the closed state, and pulls the sliding portion 525 from the rear side toward the front side when moving from the closed state to the opened state.

Next, the cover 558 will be described with reference to FIGS. 13A through 13C. The cover 558 is a member for causing the sliding portion 525 to move by sliding as described above. Note that the configuration causing the sliding portion 525 to move by sliding is not restricted to the cover 558. For example, a configuration may be made where the sliding portion 525 moves by sliding in conjunction with opening/closing of an unshown front door. Alternatively, a configuration may be made where the sliding portion 525 moves by sliding in conjunction with turning of a turning member such as a lever or the like, rather than a covering member such as the cover 558 or a door.

Figure 13A:
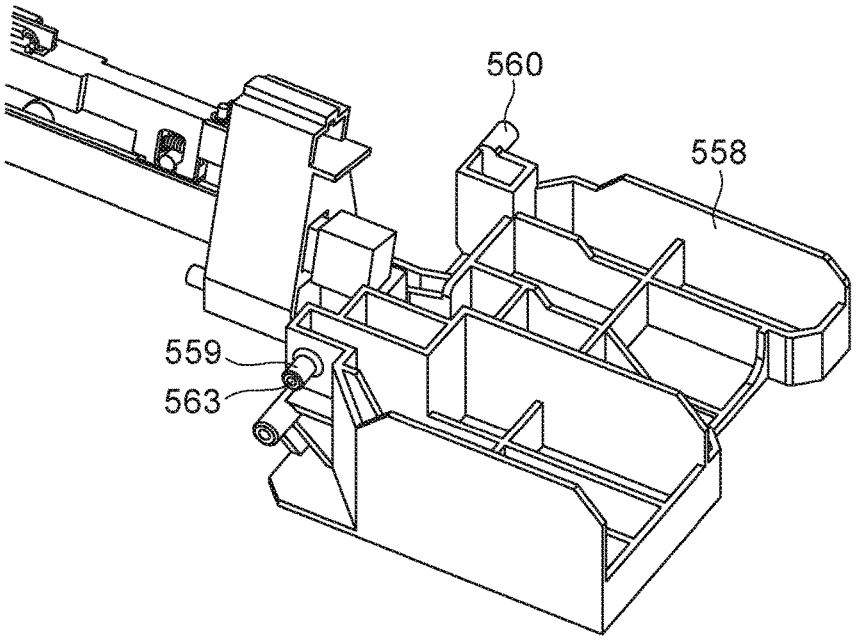
FIGS. 13A through 13C are perspective views of a cover.

FIG. 13A is a perspective view of the cover 558. The cover 558 has a pivoting shaft portion 559 and a pivoting shaft portion 560, as illustrated in FIG. 13A. The pivoting shaft portion 559 is a cylindrical protrusion protruding in the right-side direction of the cover 558, while the pivoting shaft portion 560 is a cylindrical protrusion protruding in the left-side direction of the cover 558.

Figure 13B:
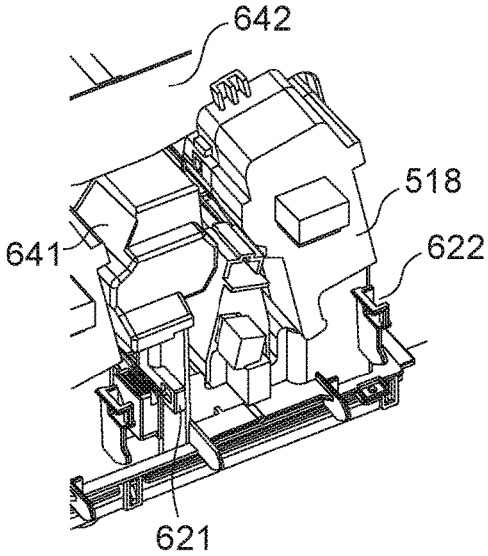
Figure 13C:
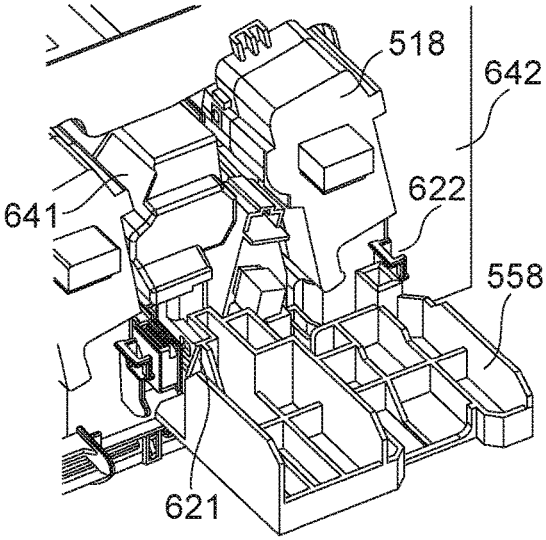

FIG. 13B is an enlarged view of the portion where the cover 558 is attached to the front-side plate 642. FIG. 13C is a perspective view of the cover 558 that has been attached to the front-side plate 642. The front-side plate 642 has a bearing member 621 to which the pivoting shaft portion 559 of the cover 558 fits, and a bearing member 622 to which the pivoting shaft portion 560 fits, as illustrated in FIG. 13B. The pivoting shaft portion 559 of the cover 558 pivotably fits to the bearing member 621 of the front-side plate 642, and the pivoting shaft portion 560 fits to the bearing member 622 of the front-side plate 642, as illustrated in FIG. 13C. The pivoting axis of the pivoting shaft portion 559 and the pivoting axis of the pivoting shaft portion 560 are on a pivoting axis 563, as illustrated in FIG. 13A. The cover 558 opens and closes as to the main body of the image forming apparatus 1, with the pivoting axis 563 as the center of pivoting. The closed cover 558 is situated on the inserting/extracting path of the drum unit 518 and developing unit 641. Accordingly, when the cover 558 is in a closed state, replacement of the drum unit 518 and developing unit 641 cannot be performed by the worker. The worker can replace the drum unit 518 by opening the cover 558, and closes the cover 558 when the work is completed.

Figure 14A:
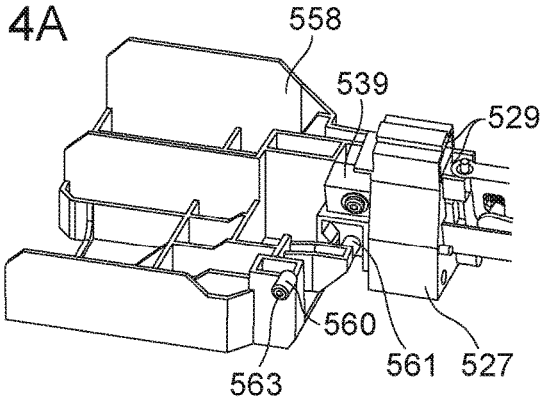
FIGS. 14A through 14D are perspective views of a cover, for description of operations when the cover is closed.
Figure 14B:
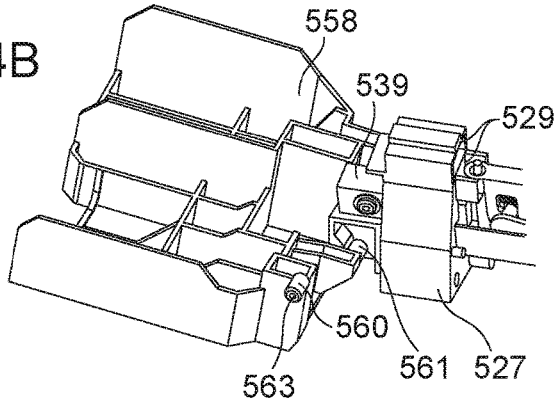

Next, the configuration by which the sliding portion 525 moves by sliding in the rotational axis direction of the photosensitive drum 103 in conjunction with opening/closing operations of the cover 558 will be described with reference to FIGS. 14A through 17D. FIGS. 14A through 14D are perspective diagrams illustrating the cover 558 pivoting from an opened state toward a closed state. FIGS. 15A through 15D are cross-sectional views illustrating the cover 558 pivoting from the opened state toward the closed state. FIGS. 14A and 15A illustrate the opened state of the cover 558. FIGS. 14D and 15D illustrate the closed state of the cover 558. FIGS. 14B and 15B, and FIGS. 14C and 15C, are diagrams illustrating the cover 558 transitioning from the opened state to the closed state. Note that the closed state of the cover 558 in the closed state illustrated in FIGS. 14D and 15D is maintained by a snap fit mechanism for engaging to the main body, a stopper for preventing pivoting, or the like.

The cover 558 pivots as to the main body of the image forming apparatus 1 on the pivoting axis 563, as illustrated in FIGS. 14A through 14D. The cover 558 has the cylindrical pressing member 561 protruding from the left side toward the right side. The pressing member 561 is situated within the accommodation space 562 provided to the one end of the sliding portion 525, as illustrated in FIGS. 14A through 14D. The pressing member 561 moves over a movement path 564 in conjunction with pivoting of the cover 558, as illustrated in FIGS. 15A through 15D.

Figure 15A:
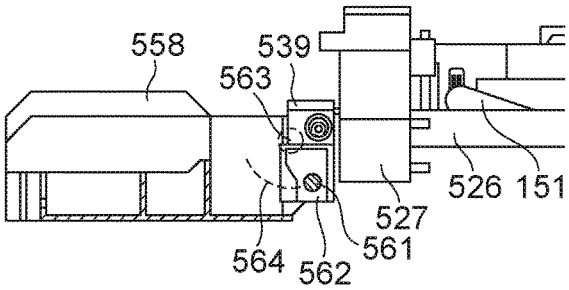
FIGS. 15A through 15D are side views of a cover, for description of operations when the cover is closed.
Figure 15B:
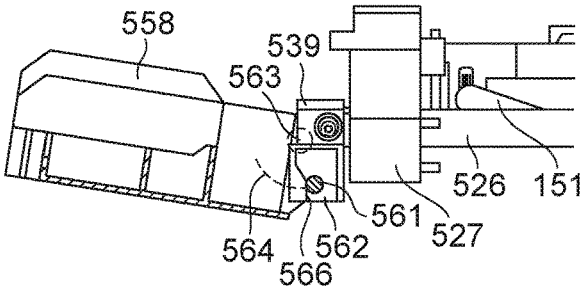

The operations of the pressing member 561 on the sliding portion 525 will be described with reference to FIGS. 15A through 15D. When the cover 558 pivots in the clockwise direction from the state in FIG. 15A, the pressing member 561 is situated on the movement path 564, and comes into contact with an abutting face 566 that intersects with the movement path 564 (FIG. 15B). When the cover 558 further pivots in the clockwise direction from this state, the pressing member 561 presses the abutting face 566 to the front side while rubbing against the abutting face 566. Accordingly, the slide aiding member 539 moves toward the front side. The slide aiding member 539 is fixed to the sliding portion 525, so the sliding portion 525 also moves by sliding toward the front side, in conjunction with the movement of the slide aiding member 539.

Figure 15C:
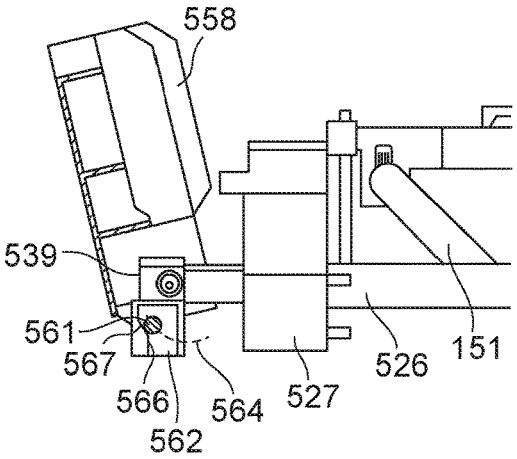

Further, when the cover 558 pivots even more in the clockwise direction, the pressing member 561 moves from the abutting face 566 to an abutting face 567 (FIG. 15C). The abutting face 567 has a curved face that generally follows the movement path 564 of the pressing member 561. Accordingly, in a case where the cover 558 further pivots in the clockwise direction from the state in FIG. 15C, the pressing member 561 comes into contact with the abutting face 567 and moves upwards, but no force for further moving the slide aiding member 539 by sliding toward the front side is applied form the pressing member 561.

Figure 14C:
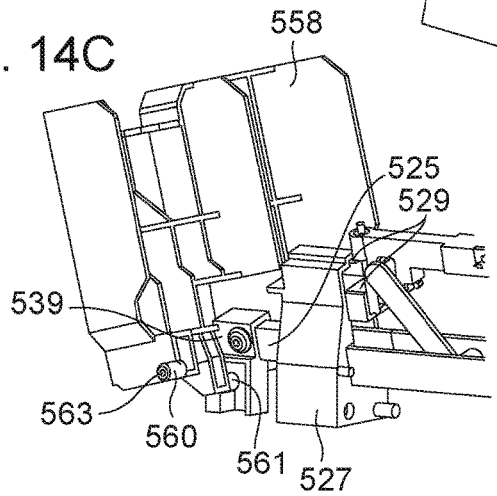
Figure 14D:
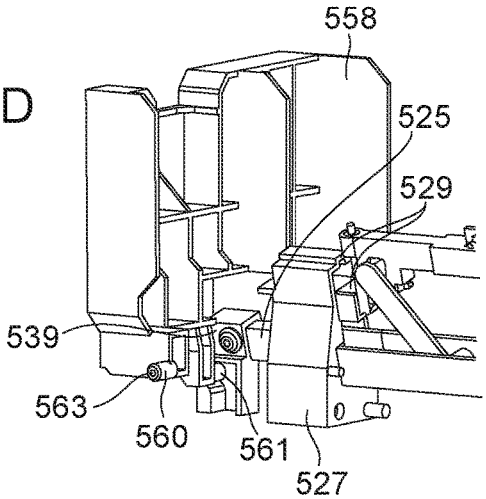
Figure 15D:
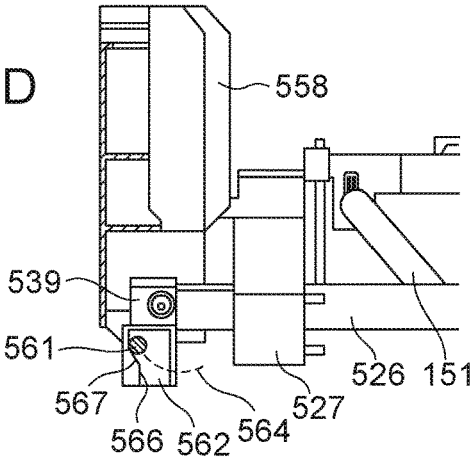

It can be seen from FIGS. 14C and 15C that when the cover 558 pivots from the opened state toward the closed state, the pressing member 561 abuts the abutting face 567 at the front side of the accommodation space 562 immediately after the holding member 505 has reached the exposure position. The abutting face 567 has a shape generally following the movement path 564 of the pressing member 561, which is an arc shape centered on the pivoting axis 563. Accordingly, in a case of further pivoting the cover 558 from the state in FIG. 15C in the clockwise direction, the pressing member 561 moves sliding over the abutting face 567 that it abuts. However, no force to further move the slide aiding member 539 toward the front side is applied from the pressing member 561. Accordingly, the slide aiding member 539 does not move from the rear side toward the front side while the pressing member 561 is moving over the abutting face 567. That is to say, the movement mechanism 140 according to the present embodiment is configured such that when the cover 558 pivots in a state where the pressing member 561 is abutting the abutting face 566, the sliding portion 525 moves by sliding in conjunction with the movement of the pressing member 561, but the sliding portion 525 does not move by sliding even if the cover 558 pivots in a state where the pressing member 561 is abutting the abutting face 567. By further pivoting the cover 558 from the state in FIG. 15C in the clockwise direction, the cover 558 reaches the closed state illustrated in FIG. 15D.

Figure 16A:
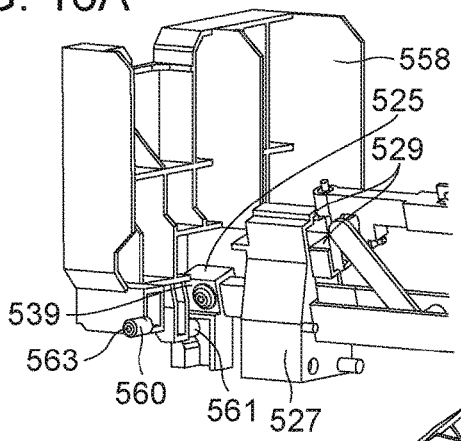
FIGS. 16A through 16D are perspective views of a cover, for description of operations when the cover is opened.
Figure 16B:
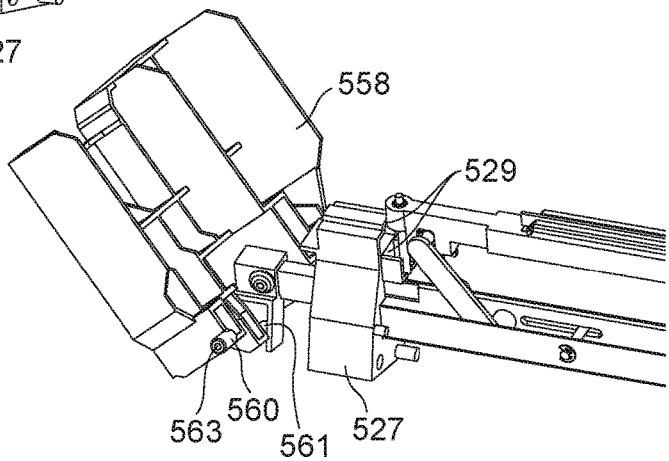
Figure 16C:
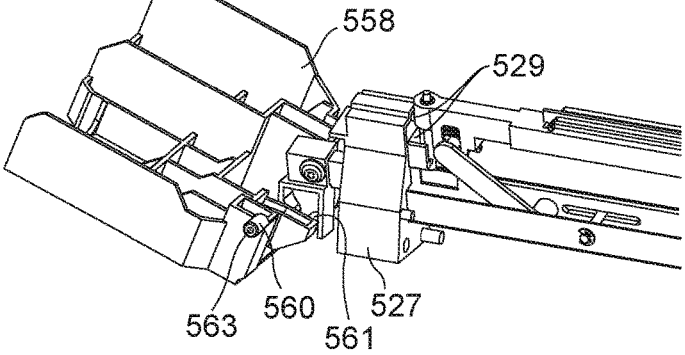
Figure 16D:
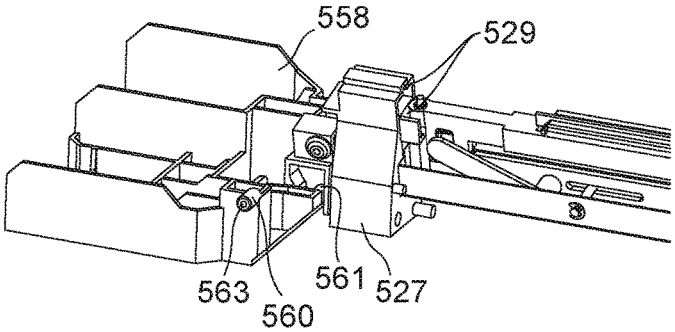
Figure 17A:
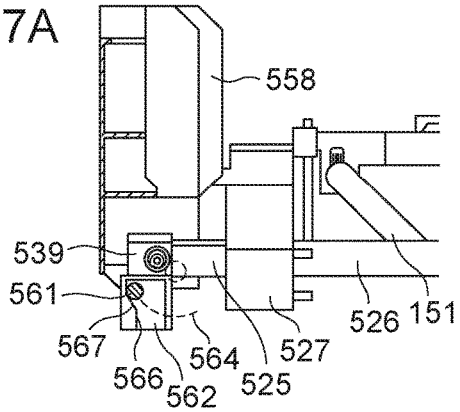
FIGS. 17A through 17D are side views of a cover, for description of operations when the cover is opened.

FIGS. 16A through 16D are perspective diagrams illustrating the cover 558 pivoting from the closed state toward the opened state. FIGS. 17A through 17D are cross-sectional views illustrating the cover 558 pivoting from the closed state toward the opened state. FIGS. 16A and 17A illustrate the closed state of the cover 558. FIGS. 16D and 17D illustrate the opened state of the cover 558. FIGS. 16B and 17B, and FIGS. 16C and 17C, are diagrams illustrating the cover 558 transitioning from the closed state to the opened state.

In the closed state of the cover 558 illustrated in FIG. 17A, force is placed on the sliding portion 525 via the link member 151 and link member 152 to slide from the front side toward the rear side, by the deadweight of the optical print head 105 and the restoring force of later-described springs. However, the cover 558 in the closed state is fixed to the main body of the image forming apparatus 1 so that the cover 558 does not pivot, and the pressing member 561 restricts movement of the slide aiding member 539 to the rear side, so the sliding portion 525 does not move by sliding to the rear side.

Figure 17B:
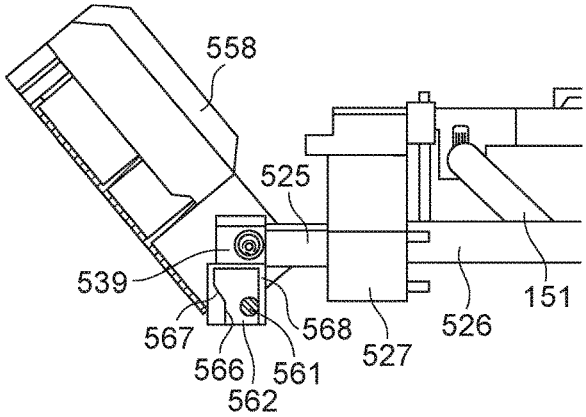
Figure 17C:
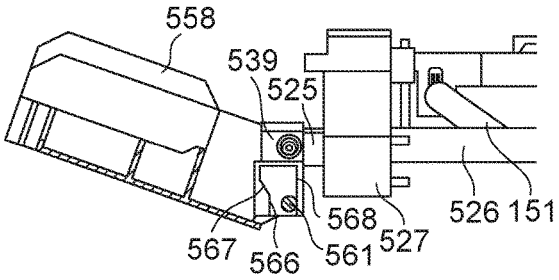
Figure 17D:
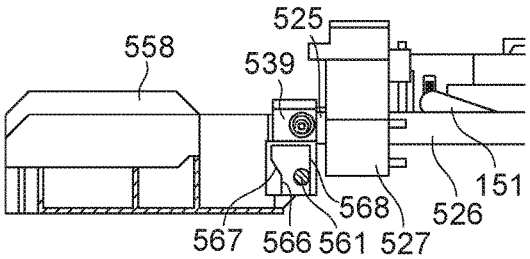

When the cover 558 pivots in the counter-clockwise direction from the state in FIG. 17A, the pressing member 561 abuts an abutting face 568, as illustrated in FIG. 17B. Upon the cover 558 further pivoting in the counter-clockwise direction from the state in FIG. 17B, the pressing member 561 presses the abutting face 568 from the front side as illustrated in FIGS. 17B and 17C, and the sliding portion 525 toward the rear side. Thereafter, further pivoting of the cover 558 in the counter-clockwise direction beings the cover 558 to the opened state as illustrated in FIG. 17D.

The mechanism where the pressing member 561 presses the abutting face 568 is provided from the following reason. That is to say, a case can be conceived where the sliding portion 525 does not move to the rear side even if restriction on movement of the slide aiding member 539 by the pressing member 561 is released by the cover 558 being pivoted in the counter-clockwise direction from the state in FIG. 16A, if frictional force between the link member 151 or link member 152 and the sliding portion 525, and frictional force between the sliding portion 525 and third support portion 526, are great. That is to say, a case can be conceived where the sliding portion 525 does not move by sliding even though the cover 558 has been opened. In order to deal with this, the movement mechanism according to the present embodiment includes the mechanism where the pressing member 561 presses the abutting face 568, so that opening the cover 558 causes the sliding portion 525 to move toward the rear side. According to the configuration described above, a worker opening and closing the cover 558 causes the sliding portion 525 to move by sliding with regard to the third support portion 526, in conjunction with movement of the cover 558.

Figure 18A:
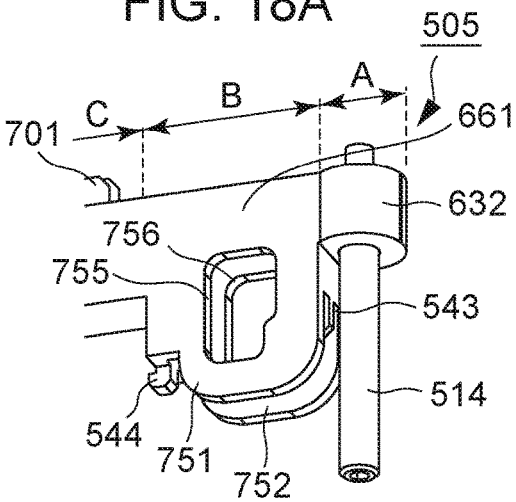
FIGS. 18A through 18D are perspective views for describing the structure of both ends of a holding member.
Figure 18B:
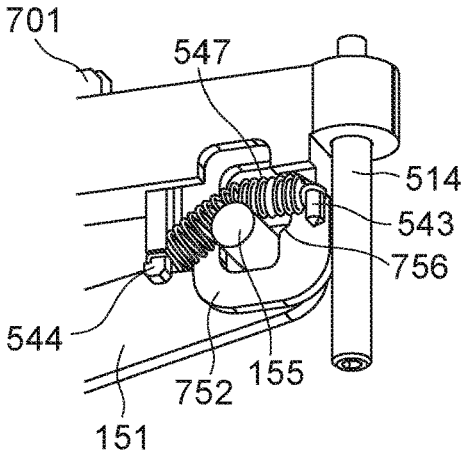
Figure 18C:
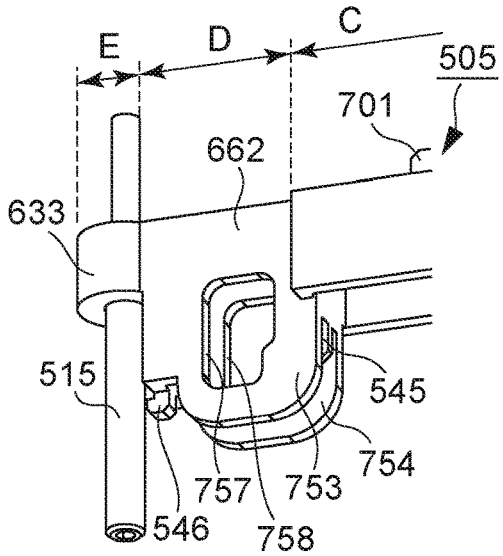
Figure 18D:
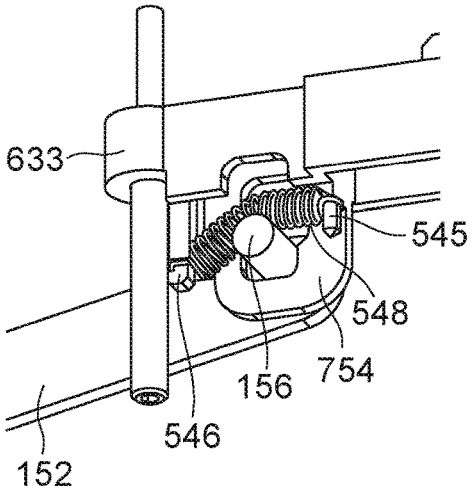

Next, a connection mechanism between the holding member 505 and the link member 151 will be described. FIGS. 18A and 18C are perspective views illustrating the one end side of the holding member 505 in the front-and-rear direction. FIGS. 18B and 18D are perspective views illustrating the other end side of the holding member 505 in the front-and-rear direction.

The holding member 505 is provided with the lens attaching portion 701 to which the lens array 506 is attached, the spring attaching portion 661 to which a coil spring 547 that is an example of a first spring is attached, the spring attaching portion 662 to which a coil spring 548 that is an example of a second spring is attached, the pin attaching portion 632 to which the abutting pin 514 is attached, and the pin attaching portion 633 to which the abutting pin 515 is attached, as illustrated in FIG. 18A. The lens attaching portion 701, spring attaching portion 661, spring attaching portion 662, pin attaching portion 632, and pin attaching portion 633 are an integral molded article formed by injection molding. The spring attaching portion 661 is disposed to the front side of the lens attaching portion 701, and further the pin attaching portion 632 is disposed to the front side of the spring attaching portion 661 in the holding member 505. The spring attaching portion 662 is disposed to the rear side of the lens attaching portion 701, and further the pin attaching portion 632 is disposed to the rear side of the spring attaching portion 662 in the holding member 505. The places where the lens attaching portion 701, spring attaching portion 661, and pin attaching portion 632 are formed in the holding member 505 are region C, region B, and region A in FIG. 18A. Also, the places where the lens attaching portion 701, spring attaching portion 662, and pin attaching portion 633 are formed in the holding member 505 are region C, region D, and region E in FIG. 18C. Biasing force is applied to the holding member 505 from the lower side toward the upper side by the protrusion 155 of the link member 151 via the coil spring 547, at a position to the front side from the lens array 506 but to the rear side from the abutting pin 514.

First, description will be made regarding the spring attaching portion 661. The spring attaching portion 661 includes a first wall portion 751, a second wall portion 752, a first engaging portion 543, and a second engaging portion 544. The first wall portion 751 is disposed to the one side of the holding member 505 in the left-and-right direction, and the second wall portion 752 is disposed to the other side of the holding member 505 in the left-and-right direction. The first wall portion 751 and second wall portion 752 are disposed to the left and right sides of the abutting pin 514 in the present embodiment. The first wall portion 751 and second wall portion 752 each have an inner wall face facing each other, as illustrated in FIG. 18A. An opening 755 is formed in the first wall portion 751, and an opening 756 is formed in the second wall portion 752. The opening 755 and the opening 756 are slots extending in the vertical direction. The protrusion 155 is inserted to the opening 755 and opening 756. The protrusion 155 is not fit to the opening 755 and opening 756, and is inserted with a gap of around 0.5 mm even at the narrowest place in the front-and-rear direction. Accordingly, the direction of movement of the protrusion 155 is guided in the vertical direction by the opening 755 and opening 756, without any great frictional force being applied by the inner wall faces of the opening 755 and opening 756.

FIG. 18B is a diagram where the first wall portion 751 has been omitted from illustration in FIG. 18A. The first engaging portion 543 (first attaching portion) and second engaging portion 544 (first attaching portion) are disposed between the first wall portion 751 and second wall portion 752 in the left-and-right direction (pair of first attaching portions). The first engaging portion 543 and second engaging portion 544 also are respectively disposed on the front side and rear side of the opening 755 and opening 756 in the front-and-rear direction. The first engaging portion 543 is disposed further toward the front side of the holding member 505 than the second engaging portion 544 in the present embodiment. The first engaging portion 543 and second engaging portion 544 are protrusions that protrude downwards from connecting portions connecting the first wall portion 751 and second wall portion 752 of the holding member 505. One end side of the coil spring 547 in the longitudinal direction of the coil spring 547 is engaged with the first engaging portion 543, and the other end side of the coil spring 547 in the longitudinal direction of the coil spring 547 is engaged with the second engaging portion 544. The first engaging portion 543 and second engaging portion 544 are disposed at the spring attaching portion 661 such that the coil spring 547 that is engaged at the first engaging portion 543 and second engaging portion 544 traverses the opening 755 and opening 756.

The first engaging portion 543 and second engaging portion 544 are disposed at positions that are different from each other in the vertical direction. The first engaging portion 543 is disposed closer to the photosensitive drum 103 side than the second engaging portion 544 in the present embodiment. Note that an arrangement may be made where the first engaging portion 543 and second engaging portion 544 are at positions that are generally the same height in the vertical direction, and the second engaging portion 544 may be disposed closer to the photosensitive drum 103 side than the first engaging portion 543.

The protrusion 155 is inserted to the opening 756 of the second wall portion 752 from the outer wall face side thereof, passes beneath the coil spring 547 strung between the first engaging portion 543 and second engaging portion 544, and is inserted into the opening 755 of the first wall portion 751, as illustrated in FIG. 18B.

Next, description will be made regarding the spring attaching portion 662. The spring attaching portion 662 includes a third wall portion 753, a fourth wall portion 754, a third engaging portion 545 (second attaching portion), and a fourth engaging portion 546 (second attaching portion) (pair of second attaching portions), as illustrated in FIG. 18C. The third wall portion 753 is disposed to the one side of the holding member 505 in the left-and-right direction, and the fourth wall portion 754 is disposed to the other side of the holding member 505 in the left-and-right direction. The third wall portion 753 and fourth wall portion 754 are disposed to the left and right sides of the abutting pin 515 in the present embodiment. The first wall portion 751 and the third wall portion are disposed on the same side in the left-and-right direction, i.e., the first wall portion 751 and the third wall portion 753 are disposed on the right side of the holding member 505 in the left-and-right direction. The second wall portion 752 and the fourth wall portion 754 are disposed on the same side in the left-and right direction, i.e., the second wall portion 752 and the fourth wall portion 754 are disposed on the left side of the holding member 505 in the left-and-right direction.

The third wall portion 753 and fourth wall portion 754 each have an inner wall face facing each other, as illustrated in FIG. 18C. An opening 757 is formed in the third wall portion 753, and an opening 758 is formed in the fourth wall portion 754. The opening 757 and the opening 758 are slots extending in the vertical direction. The protrusion 156 serving as an example of a second moving portion is inserted to the opening 757 and opening 758. The protrusion 156 is not fit to the opening 757 and opening 758, and is inserted with a gap of around 0.5 mm even at the narrowest place in the front-and-rear direction. Accordingly, the direction of movement of the protrusion 156 is guided in the vertical direction by the opening 757 and opening 758, without any great frictional force being applied by the inner wall faces of the opening 757 and opening 758.

FIG. 18D is a diagram where the third wall portion 753 has been omitted from illustration in FIG. 18C. The third engaging portion 545 and fourth engaging portion 546 are disposed between the third wall portion 753 and fourth wall portion 754 in the left-and-right direction. The third engaging portion 545 and fourth engaging portion 546 also are respectively disposed on the front side and rear side of the opening 757 and opening 758 in the front-and-rear direction. The fourth engaging portion 546 is disposed further toward the rear side of the holding member 505 than the third engaging portion 545 in the present embodiment. The third engaging portion 545 and fourth engaging portion 546 are protrusions that protrude downwards from connecting portions connecting the third wall portion 753 and fourth wall portion 754 of the holding member 505. One end side of the coil spring 548 in the longitudinal direction of the coil spring 548 is engaged with the third engaging portion 545, and the other end side of the coil spring 548 in the longitudinal direction of the coil spring 548 is engaged with the fourth engaging portion 546. The third engaging portion 545 and fourth engaging portion 546 are disposed at the spring attaching portion 662 such that the coil spring 548 that is engaged at the third engaging portion 545 and fourth engaging portion 546 traverses the opening 757 and opening 758.

The third engaging portion 545 and fourth engaging portion 546 are disposed at positions that are different from each other in the vertical direction. The third engaging portion 545 is disposed closer to the photosensitive drum 103 side than the fourth engaging portion 546 in the present embodiment. Note that an arrangement may be made where the third engaging portion 545 and fourth engaging portion 546 are at positions that are generally the same height in the vertical direction, and the fourth engaging portion 546 may be disposed closer to the photosensitive drum 103 side than the third engaging portion 545.

The protrusion 156 is inserted to the opening 758 of the fourth wall portion 754 from the outer wall face side thereof, passes beneath the coil spring 548 strung between the third engaging portion 545 and fourth engaging portion 546, and is inserted into the opening 757 of the third wall portion 753, as illustrated in FIG. 18D. Although a coil spring has been described as an example of the coil spring 547 and coil spring 548 in the present embodiment, plate springs may be used instead.

Next, the operations of the protrusion 155 provided to the link member 151 on the coil spring 547, and the operations of the protrusion 156 provided to the link member 152 on the coil spring 548, will be described with reference to FIGS. 19A through 19C. The operations of the protrusion 155 on the coil spring 547 and the operations of the protrusion 156 on the coil spring 548 are the same, so the operations of the protrusion 156 on the coil spring 548 will be exemplified in FIGS. 19A through 19C.

Figure 19A:
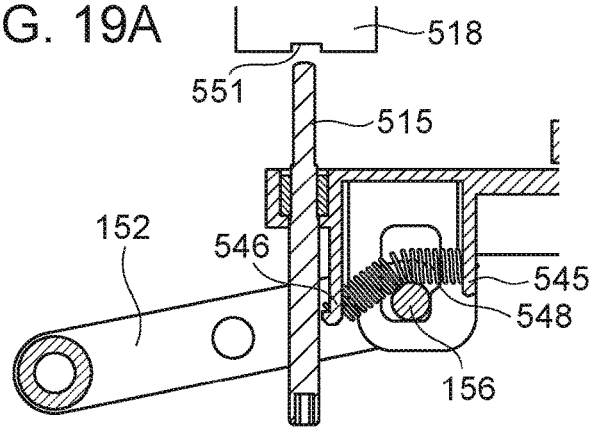
FIGS. 19A through 19C are side views for describing the structure of the other end of the holding member.

FIG. 19A is a diagram illustrating a state where the abutting pin 515 provided to the holding member 505 is retracted from the abutting face 551 of the drum unit 518. FIG. 19B is a diagram illustrating the point in time of the abutting pin 515 abutting the abutting face 551 of the drum unit 518. FIG. 19C is a diagram illustrating a state where the link member 152 has pivoted in the counter-clockwise direction from the state in FIG. 19B.

Upon the sliding portion 525 moving by sliding in the state in FIG. 19A, the link member 152 pivots in the counter-clockwise direction in conjunction therewith, and the protrusion 156 moves upwards. At this time, the protrusion 156 presses the coil spring 548 upwards. The protrusion 156 pressing the coil spring 548 upwards causes upward force to be applied to the holding member 505 via the third engaging portion 545 and fourth engaging portion 546. The abutting pin 515 is not in contact with the drum unit 518, and there is no force countering the force of the protrusion 156 pressing the coil spring 548, other than the gravity acting on the optical print head 105. Accordingly, when the upward force acting on the third engaging portion 545 and the fourth engaging portion 546 exceeds the gravity acting on the optical print head 105, the holding member 505 moves upwards by the force acting on the third engaging portion 545 and fourth engaging portion 546. Now, an arrangement may be made where, when the holding member 505 is in the retracted position, the lower ends of the abutting pin 515 (514) and holding member 505 are supported by the apparatus main body, and the protrusion 156 (155) of the link member 152 (151) is not in contact with the coil spring 548 (547). The holding member 505 is supported by the abutting face 586 when the optical print head 105 moves to the retracted position in the present embodiment. In other words, the holding member 505 that is moved from the exposure position toward the retracted position abuts the abutting face 586 from above in the vertical direction and stops, and thus is at the retracted position. The non-contact state between the protrusion 156 (155) and coil spring 548 (547) is maintained by the abutting face 586 supporting the holding member 505 from below in the vertical direction.

Figure 19B:
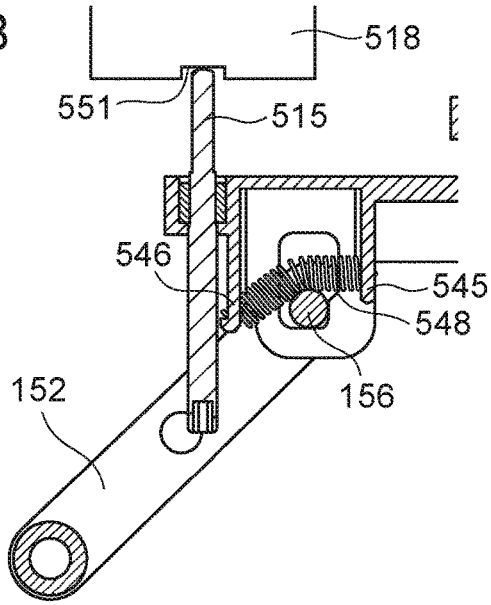

When the holding member 505 moves upwards, the abutting pin 515 abuts the abutting face 551 of the drum unit 518 as illustrated in FIG. 19B. In FIG. 19B, the optical print head 105 is situated at the exposure position, but the biasing force acting to the optical print head 105 to bias the optical print head 105 against the drum unit 518 is insufficient. Accordingly, the movement mechanism 140 according to the present embodiment has a configuration where the link member 152 is capable of further pivoting from the state in FIG. 19B, to apply the biasing force to the optical print head 105.

Further pivoting the link member 152 in the counter-clockwise direction from the state in FIG. 19B does not change the position of the holding member 505, since the abutting pin 515 is already abutting the abutting face 551 of the drum unit 518. On the other hand, the protrusion 156 moves upwards, so the coil spring 548 is pressed by the protrusion 156 passing between the third engaging portion 545 and fourth engaging portion 546, and flexes and stretches as illustrated in FIG. 19C.

Figure 19C:
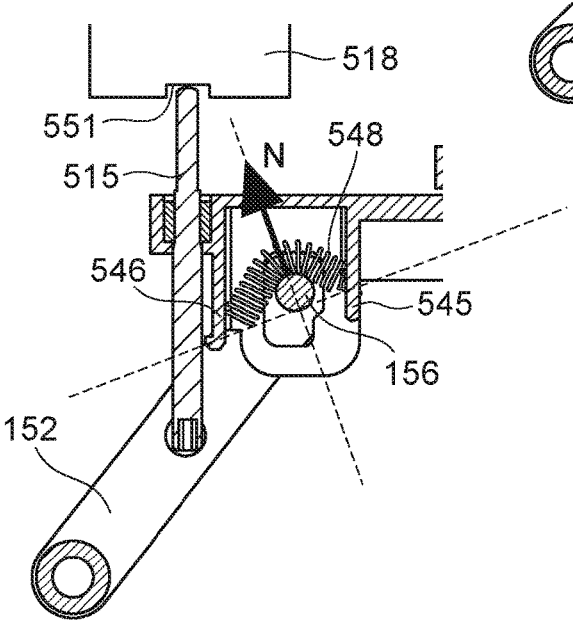

The state in FIG. 19C corresponds to the state of the cover 558 in FIGS. 15C and 15D. That is to say, the sliding portion 525 is in a state where there is no further movement by sliding toward the front side. Accordingly, the link member 152 does not pivot further in the counter-clockwise direction from the state in FIG. 19C, since the sliding portion 525 does not move by sliding, and the protrusion 156 does not move upwards and is stationary at the position in FIG. 19C. The contacting force of the coil spring 548 acts on the third engaging portion 545 and fourth engaging portion 546 in this state. A force component of the contacting force of the coil spring 548 acting on the third engaging portion 545 and fourth engaging portion 546 is directed upwards, so biasing force acts on the holding member 505 to bias the holding member 505 toward the drum unit 518 side, and the holding member 505 is biased against the drum unit 518 via the abutting pin 515.

As described above, the third engaging portion 545 is disposed closer to the photosensitive drum 103 side than the fourth engaging portion 546, so normal force in the direction of the arrow N acts on the coil spring 548 from the protrusion 156. The force component in the direction of the arrow N acts on the holding member 505. Accordingly, force toward the rear side in the front-and-rear direction acts on the abutting pin 515, and the abutting pin 515 abutting the abutting face 551 is biased against and abuts the rear-side wall face 596 at the deepest part of the fitting portion 685. The reason why the first engaging portion 543 is disposed closer to the photosensitive drum 103 side than the second engaging portion 544 is also the same. That is to say, the first engaging portion 543, second engaging portion 544, third engaging portion 545, fourth engaging portion 546, spring attaching portion 661, and spring attaching portion 662 are formed on the holding member 505 so that the coil spring 547 and coil spring 548 are generally parallel to each other.

First Modification

An example of the way in which the coil spring 547 and coil spring 548 are attached to the spring attaching portion 661 and spring attaching portion 662 will be described with reference to FIGS. 20A and 20B. Note that members having substantially the same function as those in the movement mechanism 140 are denoted by the same reference numerals in the description, and redundant description may be omitted.

Figure 20A:
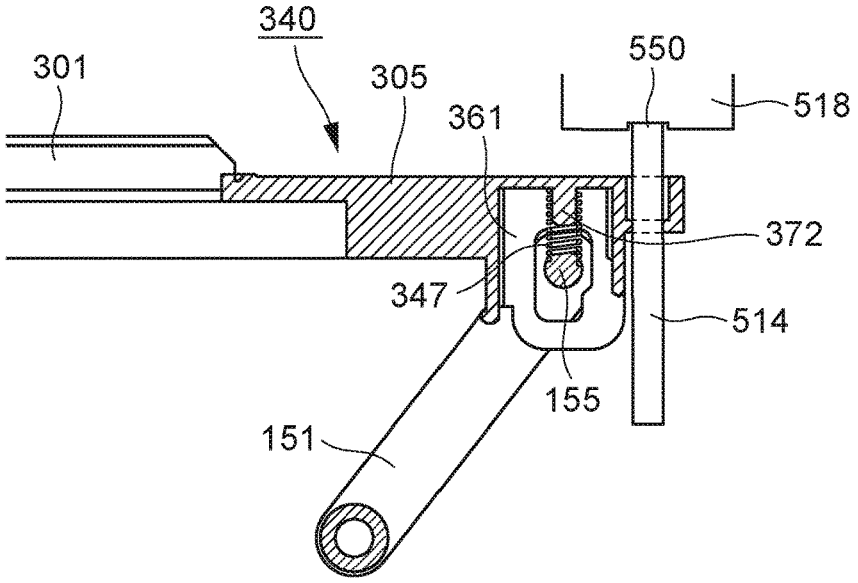
FIGS. 20A and 20B are diagrams for describing a movement mechanism according to a first modification.
Figure 20B:
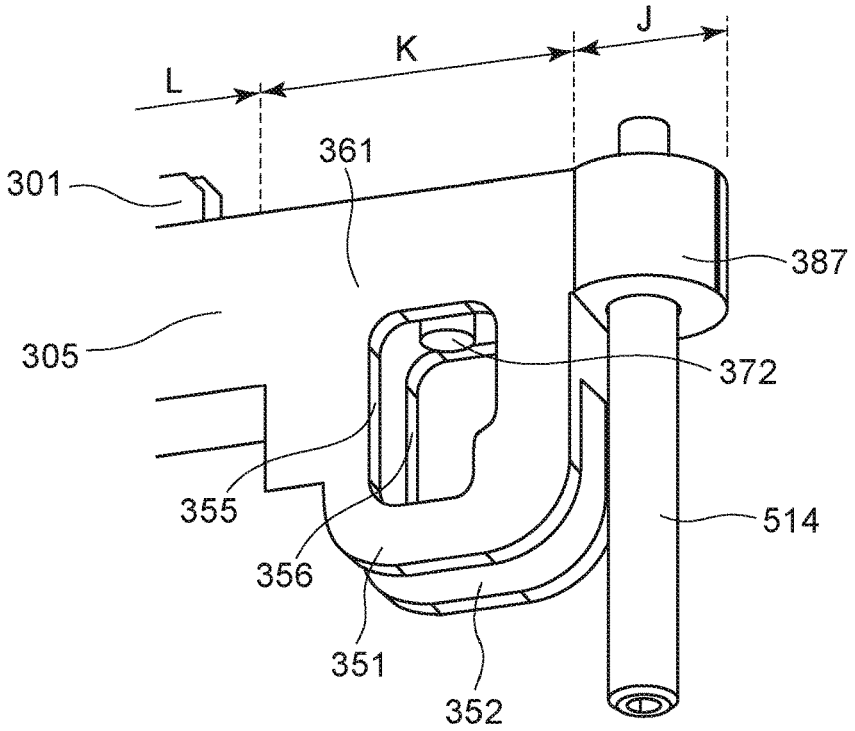

A holding member 305 illustrated in FIGS. 20A and 20B includes a lens attaching portion 301 to which the lens array 506 is attached, a spring attaching portion 361 to which a coil spring 347 is attached, a spring attaching portion 362 to which a coil spring 348 is attached, a pin attaching portion 387 to which the abutting pin 514 is attached, and a pin attaching portion 388 to which the abutting pin 515 is attached. Note that FIGS. 20A and 20B only illustrate the front side of the holding member 305, so the spring attaching portion 362 to which the coil spring 348 is attached, and the pin attaching portion 388 to which the abutting pin 515 is attached, are not illustrated. The lens attaching portion 301, spring attaching portion 361, spring attaching portion 362, pin attaching portion 387, and pin attaching portion 388, are an integral molded article formed by injection molding. The spring attaching portion 361 is disposed closer to the one end side of the holding member 305 than the lens attaching portion 301 in the front-and-rear direction, and the pin attaching portion 387 is disposed further toward the end side of the holding member 305 than the spring attaching portion 361. Also, the spring attaching portion 362 is disposed closer to the other end side of the holding member 305 than the lens attaching portion 301 in the front-and-rear direction, and the pin attaching portion 388 is disposed further toward the end side of the holding member 305 than the spring attaching portion 362.

The spring attaching portion 361 will be described with reference to FIG. 20B. The spring attaching portion 361 has a first wall portion 351, a second wall portion 352, and an engaging portion 372. The places where the lens attaching portion 301, spring attaching portion 361, and pin attaching portion 387 are formed respectively are region L, region K, and region J in FIG. 20B. The holding member 305 is applied with biasing force upwards by the protrusion 155 of the link member 151 from blow, via the coil spring 347 at a position further toward the front side from the lens array 506 and toward the rear side from the abutting pin 514. The first wall portion 351 is disposed at the one end side of the holding member 305 in the left-and-right direction, and the second wall portion 352 is disposed at the other end side of the holding member 305 in the left-and-right direction. The first wall portion 351 and second wall portion 352 are formed on both sides of the abutting pin 514 in the left-and right direction in the present modification. An opening 355 is formed in the first wall portion 351, and an opening 356 is formed in the second wall portion 352. The opening 355 and the opening 356 are slots extending in the vertical direction. The protrusion 155 is inserted to the opening 355 and opening 356 in that order from the left side of the holding member 305. The protrusion 155 is not fit to the opening 355 and opening 356, and is inserted with a gap of around 0.5 mm even at the narrowest place in the front-and-rear direction. Accordingly, the direction of movement of the protrusion 155 is guided in the vertical direction by the opening 355 and opening 356, without any great frictional force being applied by the inner wall faces of the opening 355 and opening 356. The engaging portion 372 is a cylindrical protrusion erected downwards from above between the first wall portion 351 and second wall portion 352, as illustrated in FIG. 20B. The one end of the coil spring 347 is inserted to the engaging portion 372, upwards from below, as illustrated in FIG. 20A. The other end of the coil spring 347 comes into contact with the protrusion 155. That is to say, the contact portion between the other end side of the coil spring 347 and the protrusion 155 is situated at a lower side than the contact portion between the one end side of the coil spring 347 and the engaging portion 372.

FIG. 20A illustrates a state immediately after the optical print head 105 has moved from the retracted position toward the exposure position and the abutting pin 514 has come into contact with an abutting face 550. The optical print head 105 is situated at the exposure position, but the biasing force acting on the optical print head 105 to bias the optical print head 105 against the drum unit 518 is insufficient. Accordingly, the movement mechanism 340 according to the present modification has a configuration where the link member 151 is capable of further pivoting from the state in FIG. 20A, to apply the biasing force to the optical print head 105.

Further pivoting the link member 151 in the counter-clockwise direction from the state in FIG. 20A does not change the position of the holding member 305, since the abutting pin 514 is already abutting the abutting face 550 of the drum unit 518. On the other hand, the protrusion 155 moves upwards, so the coil spring 547 is compressed between the engaging portion 372 and the protrusion 155.

The state in which the link member 151 has been further pivoted in the counter-clockwise direction from the state in FIG. 20A corresponds to the state of the cover 558 in FIGS. 14C and 14D, and FIGS. 15C and 15D. That is to say, the sliding portion 525 is in a state where there is no further movement by sliding toward the front side. Accordingly, the link member 151 does not pivot further in the counter-clockwise direction since the sliding portion 525 does not move by sliding, and the protrusion 155 does not move upwards and is stationary. The restoring force of the compressed coil spring 347 in this state acts as biasing force on the holding member 305 to bias the holding member 305 toward the drum unit 518 side, and the holding member 305 is biased against the drum unit 518 via the abutting pin 515.

Second Modification

An example of the way in which a coil spring 447 and a coil spring 448 are attached to a holding member 405 will be described with reference to FIGS. 21A and 21B. A holding member 405 illustrated in FIGS. 21A and 21B includes a lens attaching portion 401 to which the lens array 506 is attached, a spring attaching portion 461 to which the coil spring 447 is attached, a spring attaching portion 462 to which the coil spring 448 is attached, a pin attaching portion 487 to which the abutting pin 514 is attached, and a pin attaching portion 488 to which the abutting pin 515 is attached. Note that FIG. 21B only illustrates the front side of the holding member 405, so the spring attaching portion 462 to which the coil spring 448 is attached, and the pin attaching portion 488 to which the abutting pin 415 is attached, are not illustrated. The lens attaching portion 401, spring attaching portion 461, spring attaching portion 462, pin attaching portion 487, and pin attaching portion 488, are an integral molded article formed by injection molding. The spring attaching portion 461 is disposed closer to the one end side of the holding member 405 than the lens attaching portion 401 in the front-and-rear direction, and the pin attaching portion 487 is disposed further toward the end side of the holding member 405 than the spring attaching portion 461. Also, the spring attaching portion 462 is disposed closer to the other end side of the holding member 405 than the lens attaching portion 401 in the front-and-rear direction, and the pin attaching portion 488 is disposed further toward the end side of the holding member 405 than the spring attaching portion 462.

The spring attaching portion 461 will be described with reference to FIG. 21B. The spring attaching portion 461 has a first wall portion 451, a second wall portion 452, and an engaging portion 472. The places where the lens attaching portion 401, spring attaching portion 461, and pin attaching portion 487 are formed respectively are region O, region N, and region M in FIG. 21B. The first wall portion 451 is disposed at the one end side of the holding member 405 in the left-and-right direction, and the second wall portion 452 is disposed at the other end side of the holding member 405 in the left-and-right direction. The first wall portion 451 and second wall portion 452 are formed on both sides of the abutting pin 514 in the left-and-right direction in the present modification. An opening 455 is formed in the first wall portion 451, and an opening 456 is formed in the second wall portion 452. The opening 455 and the opening 456 are slots extending in the vertical direction. The protrusion 155 is inserted to the opening 455 and opening 456, from the left side of the holding member 405, in that order. The protrusion 155 is not fit to the opening 455 and opening 456, as illustrated in FIG. 21A, and is inserted with a gap of around 0.5 mm even at the narrowest place in the front-and-rear direction. Accordingly, the direction of movement of the protrusion 155 is guided in the vertical direction by the opening 455 and opening 456, without any great frictional force being applied by the inner wall faces of the opening 455 and opening 456. The engaging portion 472 is inserted from a hole formed in the first wall portion 451 toward the second wall portion 452, below the opening 455 of the first wall portion 451 and the opening 456 of the second wall portion 452 as illustrated in FIG. 21B, and is fixed to the first wall portion 451. The other end of the coil spring 447 is engaged with the engaging portion 472, between the first wall portion 451 and second wall portion 452, as illustrated in FIG. 21A. The one end side of the coil spring 447 is connected to the protrusion 155 so as to be capable of pivoting. That is to say, the contact portion between the other end side of the coil spring 447 and the protrusion 155 is situated at a higher side than the contact portion between the one end side of the coil spring 447 and the engaging portion 472.

Figure 21A:
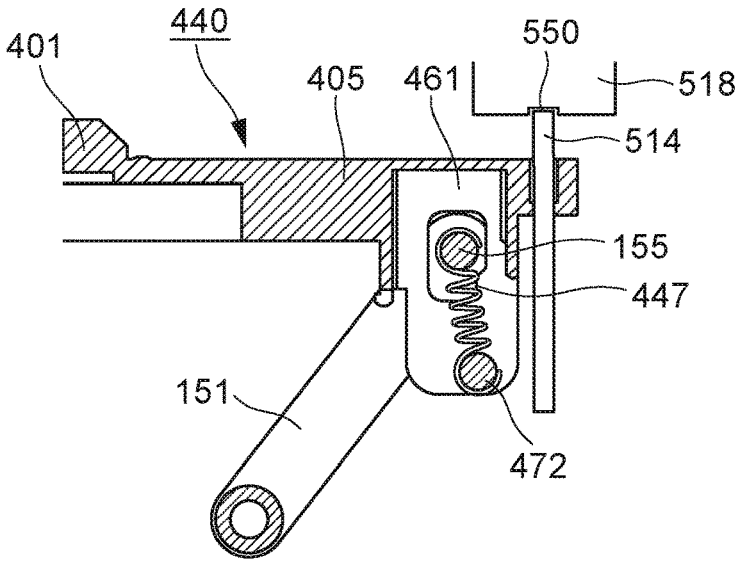
FIGS. 21A and 21B are diagrams for describing a movement mechanism according to a second modification.
Figure 21B:
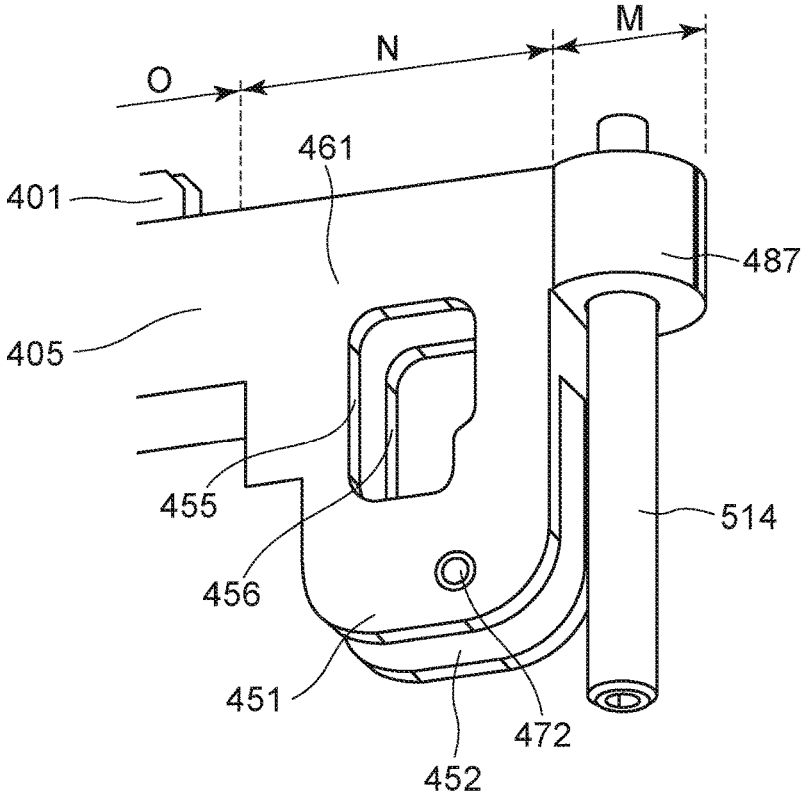

FIG. 21A illustrates a state immediately after the optical print head 105 has moved from the retracted position toward the exposure position and the abutting pin 514 has come into contact with an abutting face 550. The optical print head 105 is situated at the exposure position, but the biasing force acting on the optical print head 105 to bias the optical print head 105 against the drum unit 518 is insufficient. Accordingly, the movement mechanism 440 according to the present modification has a configuration where the link member 151 is capable of further pivoting from the state in FIG. 21A, to apply the biasing force to the optical print head 105.

Further pivoting the link member 151 in the counter-clockwise direction from the state in FIG. 21A does not change the position of the holding member 405, since the abutting pin 514 is already abutting the abutting face 550 of the drum unit 518. On the other hand, the protrusion 155 moves upwards, so the coil spring 447 is stretched by the engaging portion 472 and the protrusion 155.

The state in which the link member 151 has been further pivoted in the counter-clockwise direction from the state in FIG. 21A corresponds to the state of the cover 558 in FIGS. 14C and 14D, and FIGS. 15C and 15D. That is to say, the sliding portion 525 is in a state where there is no further movement by sliding toward the front side. Accordingly, the link member 151 does not pivot further in the counter-clockwise direction since the sliding portion 525 does not move by sliding, and the protrusion 155 does not move upwards and is stationary. The restoring force of the stretched coil spring 447 in this state acts as biasing force on the holding member 405 to bias the holding member 405 toward the drum unit 518 side, and the holding member 405 is biased against the drum unit 518 via the abutting pin 514. Note that a structure may be made where the coil spring 447 is directly stretched by the upper end portion of the link member 151 rather than the protrusion 155, i.e., the first moving portion may be the upper end portion of the link member 151.

As described above, in the image forming apparatus 1 according to the above-described embodiment and modifications, when the sliding portion 525 moves by sliding, the link member 151 and link member 152 pivot as to the sliding portion 525 with the one end of the holding member 505 (including 305 and 405) abutting the abutting portion 529, and the optical print head 105 moves toward the photosensitive drum 103.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-119007, filed Jun. 16, 2017, which is hereby incorporated by reference herein in its entirety.

What is claimed is:

1. An image forming apparatus, comprising:

a photosensitive drum;

an optical print head configured to expose the photosensitive drum; and a movement mechanism configured to move the optical print head from a retracted position that is apart from the photosensitive drum, to an exposure position that is closer to the photosensitive drum than the retracted position, to expose the photosensitive drum, wherein the movement mechanism includes a sliding portion configured to be capable of sliding movement from one end side of the optical print head in a longitudinal direction of the optical print head to another end side of the optical print head in the longitudinal direction;

wherein one end side of the sliding portion in the longitudinal direction is positioned upstream to another end side of the sliding portion in the longitudinal direction with respect to the sliding movement direction, a single first arm rotatably connected to the one end side of the sliding portion at a first connecting portion, and the one end side of the optical print head at a second connecting portion;

a single second arm rotatably connected to the another end side of the sliding portion at a third connecting portion, and the another end side of the optical print head at a fourth connecting portion;

wherein, such that the second connecting portion and the fourth connecting portion to move toward the photosensitive drum according to the rotation of the single first arm around the first connecting portion in conjunction with the movement of the first connecting portion moving toward the sliding movement direction together with the sliding portion, and according to the rotation of the single second arm around the third connecting portion in conjunction with the movement of the third connecting portion moving toward the sliding movement direction together with the sliding portion, (i) the second connecting portion supports the optical print head at a position downstream to the first connecting portion in the sliding movement direction, and at a position closer to the photosensitive drum than the first connecting portion, (ii) the fourth connecting portion supports the optical print head at a position downstream to the third connecting portion in the sliding movement direction, and at a position closer to the photosensitive drum than the third connecting portion, and (iii) the movement mechanism comprises a contact portion configured to contact with the optical print head such that the movement of the optical print head in the sliding movement direction is restricted.

2. The image forming apparatus according to claim 1, wherein the contact portion is fixed to an image forming apparatus main body further downstream in the sliding movement direction than the optical print head.

3. The image forming apparatus according to claim 1, further comprising:

a drum unit configured to rotatably support the photosensitive drum;

a first spring that is provided to the one end side of the optical print head in the longitudinal direction and that is configured to apply biasing force to the optical print head to bias the drum unit;

a second spring that is provided to the another end side of the optical print head in the longitudinal direction and that is configured to apply biasing force to the optical print head to bias the drum unit;

a first moving portion that is provided to the single first arm and that is configured to deform the first spring in conjunction with the rotating of the single first arm; and a second moving portion that is provided to the single second arm and that is configured to deform the second spring in conjunction with the rotating of the single second arm;

wherein the biasing force is applied to the optical print head by the first moving portion and the second moving portion moving toward the drum unit in conjunction with the sliding movement of the sliding portion, and the first spring being deformed by the first moving portion and the second spring being deformed by the second moving portion.

4. The image forming apparatus according to claim 3, further comprising:

a pair of first attaching portions formed at the one end side of the optical print head in the longitudinal direction, with one end side of the first spring in a longitudinal direction of the first spring and another end side of the first spring in the longitudinal direction of the first spring being respectively attached thereto; and a pair of second attaching portions formed at the another end side of the optical print head in the longitudinal direction of the optical print head, with one end side of the second spring in a longitudinal direction of the second spring and another end side of the second spring in the longitudinal direction of the second spring being respectively attached thereto, wherein the single first arm is configured to be rotatably connected to the sliding portion and the optical print head, with the first moving portion of the single first arm abutting the first spring between the one end of the first spring in the longitudinal direction of the first spring and the another end of the first spring in the longitudinal direction of the first spring, from the side of the first spring attached to the pair of first attaching portions opposite to the side at which the photosensitive drum is disposed, wherein the single second arm is configured to be rotatably connected to the sliding portion and the optical print head, with the second moving portion of the single second arm abutting the second spring between the one end of the second spring in the longitudinal direction of the second spring and the another end of the second spring in the longitudinal direction of the second spring, from the side of the second spring attached to the pair of second attaching portions opposite to the side at which the photosensitive drum is disposed, and wherein the biasing force is applied to the optical print head by the sliding portion being moved by sliding in a state where the optical print head is in contact with the drum unit, the first moving portion moving toward the photosensitive drum in conjunction with the sliding movement stretching the first spring and the second moving portion moving toward the photosensitive drum in conjunction with the sliding movement stretching the second spring, and restoring force of each of the stretched first spring and second spring acting upon the optical print head.

5. The image forming apparatus according to claim 4, wherein one first attaching portion of the pair of first attaching portions is disposed closer to the one end side of the optical print head in the longitudinal direction of the optical print head than the other first attaching portion of the pair of first attaching portions, and the one first attaching portion of the pair of first attaching portions is disposed closer to the side where the photosensitive drum is disposed than the other first attaching portion of the pair of first attaching portions, wherein one second attaching portion of the pair of second attaching portions is disposed closer to the one end side of the optical print head in the longitudinal direction of the optical print head than the other second attaching portion of the pair of second attaching portions, and the one second attaching portion of the pair of second attaching portions is disposed closer to the side where the photosensitive drum is disposed than the other second attaching portion of the pair of second attaching portions, and wherein the optical print head is biased in a direction from the one end side of the first spring in the longitudinal direction of the first spring toward the another end side of the first spring in the longitudinal direction of the first spring, by the first moving portion and the second moving portion each moving toward the drum unit in conjunction with the sliding movement of the sliding portion and deforming the first spring and the second spring in the direction of the first spring and the second spring stretching.

6. The image forming apparatus according to claim 3, wherein one end side of the first spring in a longitudinal direction of the first spring is connected to the optical print head, and the another end side of the first spring in a longitudinal direction of the first spring is connected to the first moving portion at a position that is closer to the photosensitive drum than the connecting portion of the one end side of the first spring in the longitudinal direction of the first spring and the optical print head, wherein one end side of the second spring in a longitudinal direction of the second spring is connected to the optical print head, and the another end side of the second spring in the longitudinal direction of the second spring is connected to the second moving portion at a position that is closer to the photosensitive drum than the connecting portion of the one end side of the second spring in the longitudinal direction of the second spring and the optical print head, and wherein the biasing force is applied to the optical print head, by the sliding portion moving by the sliding movement in a state where the optical print head is in contact with the drum unit, the first moving portion that moves toward the drum unit in conjunction with the sliding movement stretching the first spring and the second moving portion that moves toward the drum unit in conjunction with the sliding movement stretching the second spring, and restoring force of each of the stretched first spring and second spring acting upon the optical print head.

7. The image forming apparatus according to claim 3, wherein one end side of the first spring in a longitudinal direction of the first spring is in contact with the first moving portion, and the another end side of the first spring in the longitudinal direction of the first spring is connected to the optical print head at a position that is closer to the photosensitive drum than the portion where the one end side of the first spring in the longitudinal direction of the first spring and the first moving portion are in contact, wherein one end side of the second spring in a longitudinal direction of the second spring is in contact with the second moving portion, and the another end side of the second spring in the longitudinal direction of the second spring is connected to the optical print head at a position that is closer to the photosensitive drum than the portion where the one end side of the second spring in the longitudinal direction of the second spring and the second moving portion are in contact, and wherein the biasing force is applied to the optical print head, by the sliding portion moving by the sliding movement in a state where the optical print head is in contact with the drum unit, the first moving portion that moves toward the drum unit in conjunction with the sliding movement compressing the first spring and the second moving portion that moves toward the drum unit in conjunction with the sliding movement compressing the second spring, and restoring force of each of the compressed first spring and second spring acting upon the optical print head.

8. The image forming apparatus according to claim 3, wherein the first spring and the second spring are coil springs.

9. The image forming apparatus according to claim 3, wherein the first moving portion formed at one end side of the single first arm in a longitudinal direction of the single first arm forms the second connecting portion that is a protrusion protruding in a rotation axis direction of the single first arm that rotates as to the optical print head, and that is connected to the optical print head, and wherein the second moving portion formed at one end side of the single second arm in the longitudinal direction of the single second arm forms the fourth connecting portion that is a protrusion protruding in a rotation axis direction of the single second arm that rotates as to the optical print head, and that is connected to the optical print head.

10. The image forming apparatus according to claim 1, wherein the optical print head comprises a plurality of LEDs and exposes the photosensitive drum with the light emitted from the plurality of LEDs.

11. An image forming apparatus, comprising:

a photosensitive drum;

an optical print head configured to expose the photosensitive drum; and a movement mechanism configured to move the optical print head from a retracted position that is apart from the photosensitive drum to an exposure position that is closer to the photosensitive drum than the retracted position, to expose the photosensitive drum, wherein the movement mechanism includes a sliding portion configured to be capable of sliding movement from another end side of the optical print head in a longitudinal direction of the optical print head to one end side of the optical print head in the longitudinal direction, wherein another end side of the sliding portion in the longitudinal direction is positioned upstream to one end side of the sliding portion in the longitudinal direction with respect to the sliding movement direction, a single first arm rotatably connected to the one end side of the sliding portion at a first connecting portion, and the one end side of the optical print head at a second connecting portion;

a single second arm rotatably connected to the another end side of the sliding portion at a third connecting portion, and the another end side of the optical print head at a fourth connecting portion;

wherein, such that the second connecting portion and the fourth connecting portion to move toward the photosensitive drum according to the rotation of the single first arm around the first connecting portion in conjunction with the movement of the first connecting portion moving toward the sliding movement direction together with the sliding portion, and according to the rotation of the single second arm around the third connecting portion in conjunction with the movement of the third connecting portion moving toward the sliding movement direction together with the sliding portion, (i) the second connecting portion supports the optical print head at a position downstream to the first connecting portion in the sliding movement direction, and at a position closer to the photosensitive drum than the first connecting portion, (ii) the fourth connecting portion supports the optical print head at a position downstream to the third connecting portion with in the sliding movement direction, and at a position closer to the photosensitive drum than the third connecting portion, and (iii) the movement mechanism comprises a contact portion configured to contact with the optical print head such that the movement of the optical print head in the sliding movement direction is restricted.

12. The image forming apparatus according to claim 11, wherein the contact portion is fixed to an image forming apparatus main body further downstream in the sliding movement direction than the optical print head.

13. The image forming apparatus according to claim 11, further comprising:

a drum unit configured to rotatably support the photosensitive drum;

a first spring that is provided to the one end side of the optical print head in the longitudinal direction and that is configured to apply biasing force to the optical print head to bias the drum unit;

a second spring that is provided to the another end side of the optical print head in the longitudinal direction and that is configured to apply biasing force to the optical print head to bias the drum unit;

a first moving portion that is provided to the single first arm and that is configured to deform the first spring in conjunction with the rotating of the single first arm; and a second moving portion that is provided to the single second arm and that is configured to deform the second spring in conjunction with the rotating of the single second arm;

wherein the biasing force is applied to the optical print head by the first moving portion and the second moving portion moving toward the drum unit in conjunction with the sliding movement of the sliding portion, and the first spring being deformed by the first moving portion and the second spring being deformed by the second moving portion.

14. The image forming apparatus according to claim 13, further comprising:

a pair of first attaching portions formed at the one end side of the optical print head in the longitudinal direction, with one end side of the first spring in a longitudinal direction of the first spring and another end side of the first spring in the longitudinal direction of the first spring being respectively attached thereto; and a pair of second attaching portions formed at the another end side of the optical print head in the longitudinal direction of the optical print head, with one end side of the second spring in a longitudinal direction of the second spring and another end side of the second spring in the longitudinal direction of the second spring being respectively attached thereto, wherein the single first arm is configured to be rotatably connected to the sliding portion and the optical print head, with the first moving portion of the single first arm abutting the first spring between the one end of the first spring in the longitudinal direction of the first spring and the another end of the first spring in the longitudinal direction of the first spring, from the side of the first spring attached to the pair of first attaching portions opposite to the side at which the photosensitive drum is disposed, wherein the single second arm is configured to be rotatably connected to the sliding portion and the optical print head, with the second moving portion of the single second arm abutting the second spring between the one end of the second spring in the longitudinal direction of the second spring and the another end of the second spring in the longitudinal direction of the second spring, from the side of the second spring attached to the pair of second attaching portions opposite to the side at which the photosensitive drum is disposed, and wherein the biasing force is applied to the optical print head by the sliding portion being moved by sliding in a state where the optical print head is in contact with the drum unit, the first moving portion moving toward the photosensitive drum in conjunction with the sliding movement stretching the first spring and the second moving portion moving toward the photosensitive drum in conjunction with the sliding movement stretching the second spring, and restoring force of each of the stretched first spring and second spring acting upon the optical print head.

15. The image forming apparatus according to claim 14, wherein one first attaching portion of the pair of first attaching portions is disposed closer to the one end side of the optical print head in the longitudinal direction of the optical print head than the other first attaching portion of the pair of first attaching portions, and the one first attaching portion of the pair of first attaching portions is disposed closer to the side where the photosensitive drum is disposed than the other first attaching portion of the pair of first attaching portions, wherein one second attaching portion of the pair of second attaching portions is disposed closer to the one end side of the optical print head in the longitudinal direction of the optical print head than the other second attaching portion of the pair of second attaching portions, and the one second attaching portion of the pair of second attaching portions is disposed closer to the side where the photosensitive drum is disposed than the other second attaching portion of the pair of second attaching portions, and wherein the optical print head is biased in a direction from the one end side of the first spring in the longitudinal direction of the first spring toward the another end side of the first spring in the longitudinal direction of the first spring, by the first moving portion and the second moving portion each moving toward the drum unit in conjunction with the sliding movement of the sliding portion and deforming the first spring and the second spring in the direction of the first spring and the second spring stretching.

16. The image forming apparatus according to claim 13, wherein one end side of the first spring in a longitudinal direction of the first spring is connected to the optical print head, and the another end side of the first spring in the longitudinal direction of the first spring is connected to the first moving portion at a position that is closer to the photosensitive drum than the connecting portion of the one end side of the first spring in the longitudinal direction of the first spring and the optical print head, wherein one end side of the second spring in a longitudinal direction of the second spring is connected to the optical print head, and the another end side of the second spring in the longitudinal direction of the second spring is connected to the second moving portion at a position that is closer to the photosensitive drum than the connecting portion of the one end side of the second spring in the longitudinal direction of the second spring and the optical print head, and wherein the biasing force is applied to the optical print head, by the sliding portion moving by the sliding movement in a state where the optical print head is in contact with the drum unit, the first moving portion that moves toward the drum unit in conjunction with the sliding movement stretching the first spring and the second moving portion that moves toward the drum unit in conjunction with the sliding movement stretching the second spring, and restoring force of each of the stretched first spring and second spring acting upon the optical print head.

17. The image forming apparatus according to claim 13, wherein one end side of the first spring in a longitudinal direction of the first spring is in contact with the first moving portion, and the another end side of the first spring in the longitudinal direction of the first spring is connected to the optical print head at a position that is closer to the photosensitive drum than the portion where the one end side of the first spring in the longitudinal direction of the first spring and the first moving portion are in contact, wherein one end side of the second spring in a longitudinal direction of the second spring is in contact with the second moving portion, and the another end side of the second spring in the longitudinal direction of the second spring is connected to the optical print head at a position that is closer to the photosensitive drum than the portion where the one end side of the second spring in the longitudinal direction of the second spring and the second moving portion are in contact, and wherein the biasing force is applied to the optical print head, by the sliding portion moving by the sliding movement in a state where the optical print head is in contact with the drum unit, the first moving portion that moves toward the drum unit in conjunction with the sliding movement compressing the first spring and the second moving portion that moves toward the drum unit in conjunction with the sliding movement compressing the second spring, and restoring force of each of the compressed first spring and second spring acting upon the optical print head.

18. The image forming apparatus according to claim 13, wherein the first spring and the second spring are coil springs.

19. The image forming apparatus according to claim 13, wherein the first moving portion formed at one end side of the single first arm in a longitudinal direction of the single first arm forms the second connecting portion that is a protrusion protruding in a rotation axis direction of the single first arm that rotates as to the optical print head, and that is connected to the optical print head, and wherein the second moving portion formed at one end side of the single second arm in a longitudinal direction of the single second arm forms the fourth connecting portion that is a protrusion protruding in a rotation axis direction of the single second arm that rotates as to the optical print head, and that is connected to the optical print head.

20. The image forming apparatus according to claim 11, wherein the optical print head comprises a plurality of LEDs and exposes the photosensitive drum with the light emitted from the plurality of LEDs.

* * * * *